US011172712B2

(12) United States Patent
McHugh

(10) Patent No.: US 11,172,712 B2
(45) Date of Patent: Nov. 16, 2021

(54) GARMENT EXTENDER

(71) Applicant: Michael Benjamin McHugh, Pointe-Claire (CA)

(72) Inventor: Michael Benjamin McHugh, Pointe-Claire (CA)

( * ) Notice: Subject to any disclaimer, the term of this patent is extended or adjusted under 35 U.S.C. 154(b) by 361 days.

(21) Appl. No.: 16/408,693

(22) Filed: May 10, 2019

(65) Prior Publication Data

US 2019/0261702 A1 Aug. 29, 2019

Related U.S. Application Data

(63) Continuation-in-part of application No. 15/695,395, filed on Sep. 5, 2017, now Pat. No. 10,537,142.

(51) Int. Cl.

| | |
|---|---|
| ***A41D 1/21*** | (2018.01) |
| ***A41D 15/00*** | (2006.01) |
| ***A44B 19/24*** | (2006.01) |

(52) U.S. Cl.

CPC ..... *A41D 1/21* (2018.01); *A41D 15/00* (2013.01); *A44B 19/24* (2013.01); *A41D 2300/322* (2013.01); *A41D 2400/482* (2013.01)

(58) Field of Classification Search

CPC ..... A41D 3/00; A41D 13/0005; A41D 1/21; A41D 1/215; A41D 1/22; A41D 2400/82; A41D 2300/324; A44B 19/00; A44B 19/24; A44B 19/28; A44B 19/265; A44B 19/262

USPC ..... 2/95, 2.17, 2.15, 100, 78.4

See application file for complete search history.

(56) References Cited

U.S. PATENT DOCUMENTS

| | | | | |
|---|---|---|---|---|
| 782,803 | A | 2/1905 | Watson, Jr. | |
| 2,122,442 | A | 7/1938 | Palmer et al. | |
| 3,875,623 | A | 4/1975 | Johnston | |
| 5,140,727 | A | 8/1992 | Dais et al. | |
| 5,273,511 | A | 12/1993 | Boeckman | |
| 5,758,868 | A | 6/1998 | Shea | |
| 5,813,094 | A | 9/1998 | Perez, II | |
| 5,934,806 | A | 8/1999 | Tomic | |
| 6,493,909 | B2 | 12/2002 | Paul | |
| 7,979,965 | B2 * | 7/2011 | Lo | A44B 11/06 24/504 |
| 8,806,726 | B1 * | 8/2014 | Lo | A45F 5/02 24/516 |
| 2010/0107300 | A1 | 5/2010 | Yiu | |
| 2010/0138973 | A1 | 6/2010 | Summons | |
| 2014/0189930 | A1 | 7/2014 | Solomon | |
| 2015/0110268 | A1 * | 4/2015 | Wilkinson | H04L 9/0869 380/46 |

(Continued)

FOREIGN PATENT DOCUMENTS

| | | |
|---|---|---|
| DE | 102013109704 | 3/2015 |
| GB | 2561522 | 10/2018 |

(Continued)

OTHER PUBLICATIONS

Pictures taken by the applicant and provided in file "Exhibit_A.pdf" of two physical products that were known by the applicant at least as early as Dec. 2014 and Dec. 2019.

(Continued)

*Primary Examiner* — Timothy K Trieu

(57) ABSTRACT

A garment extender securable to a slide fastener of a garment. The garment extender includes an attachment at least partially covered by a foldable material.

21 Claims, 18 Drawing Sheets

(56) References Cited

U.S. PATENT DOCUMENTS

2017/0079345 A1* 3/2017 Garner ..... A41D 15/00

FOREIGN PATENT DOCUMENTS

WO 2016109761 12/2015
WO WO-2016109761 A1 * 7/2016 ..... A41D 15/002

OTHER PUBLICATIONS

Pictures taken by the applicant and provided in file "Exhibit_A.pdf" of a physical product that was known by the applicant at least as early as Dec. 2014.

* cited by examiner

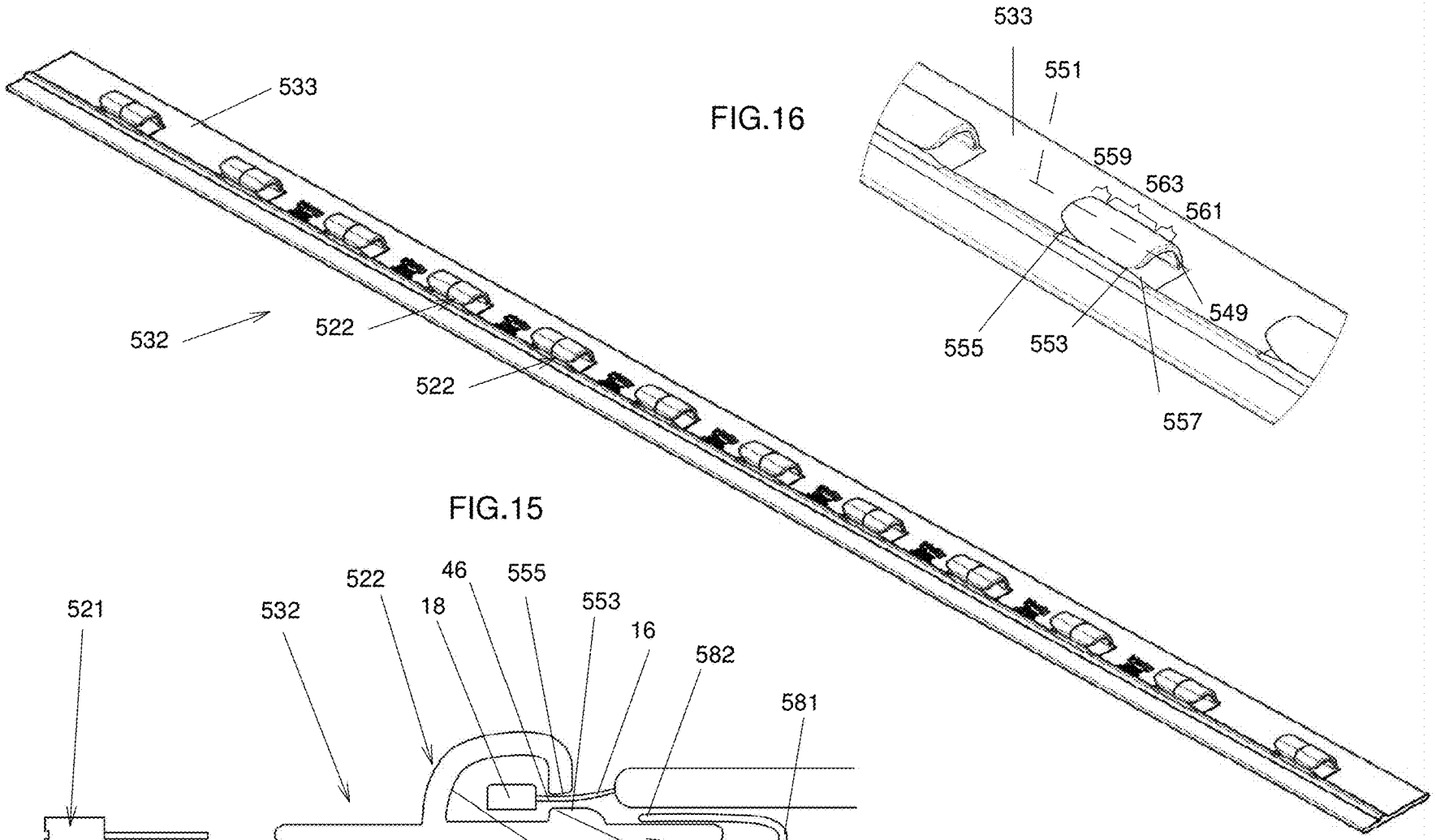
FIG.16
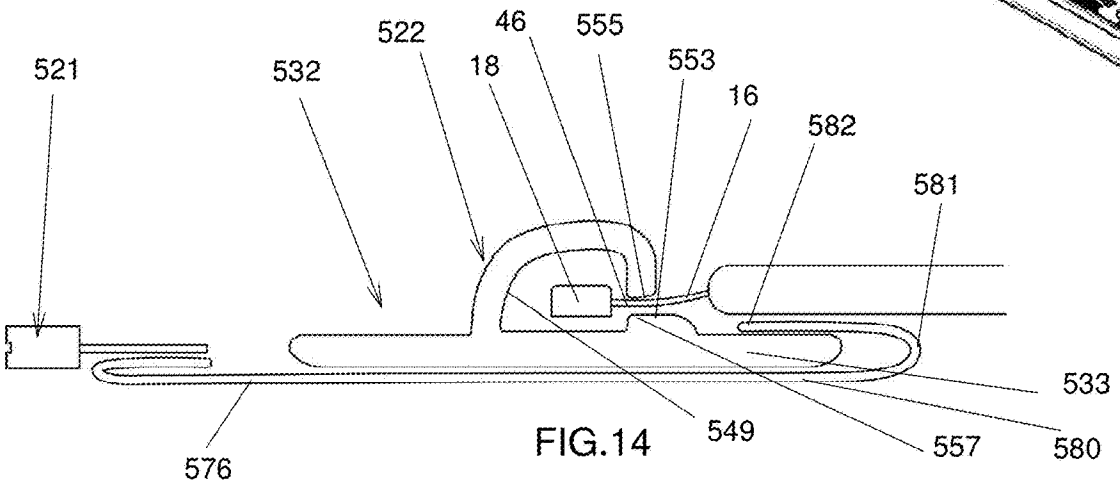
FIG.15
FIG.14

FIG. 25
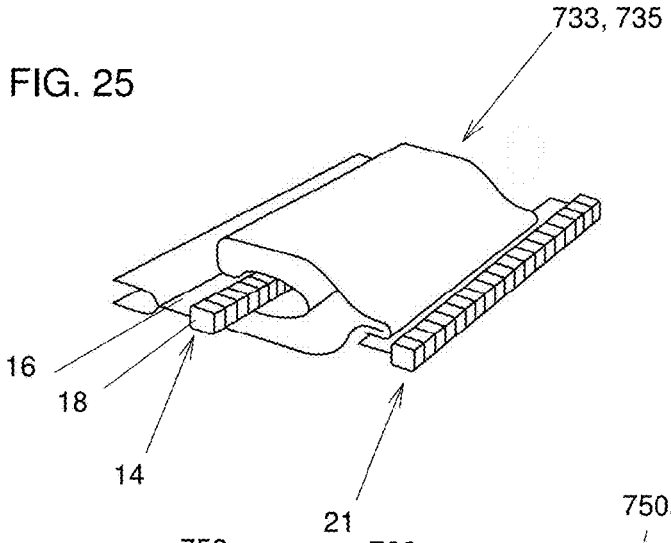
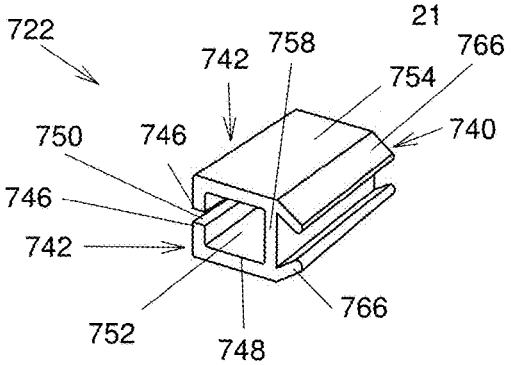
FIG. 23
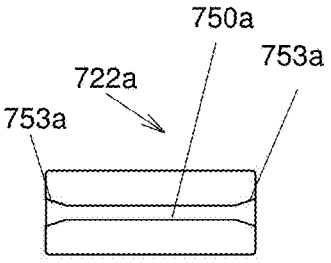
FIG. 26
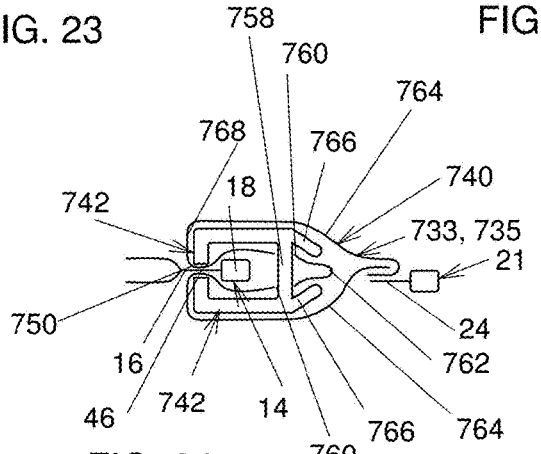
FIG. 24
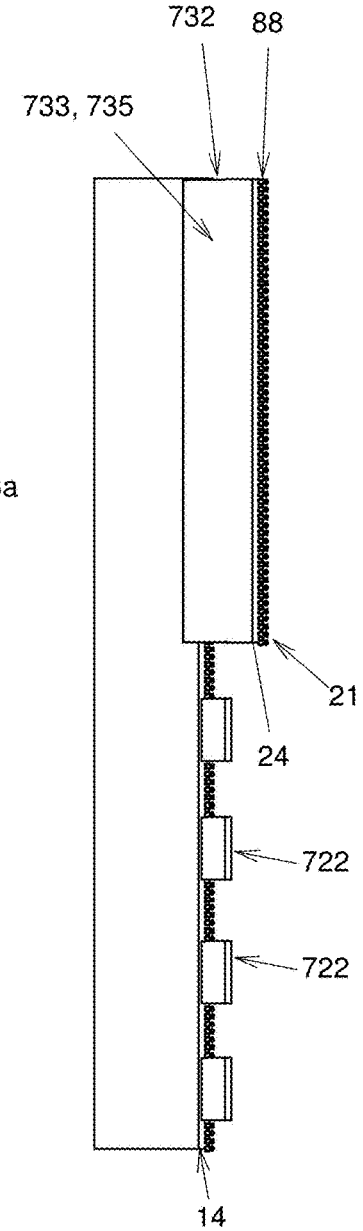
FIG. 22

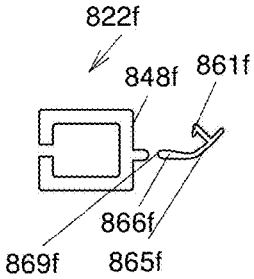
FIG. 66
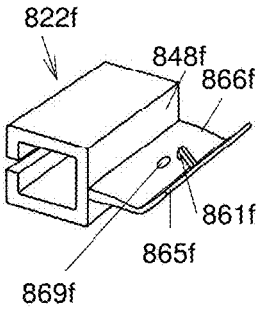
FIG. 65
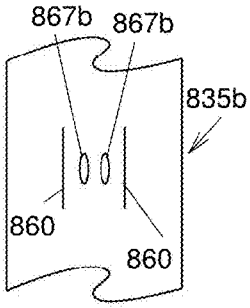
FIG. 67
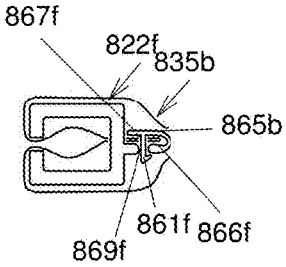
FIG. 68
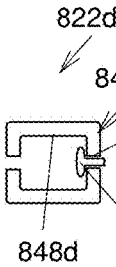
FIG. 58
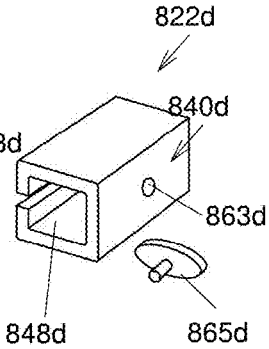
FIG. 57
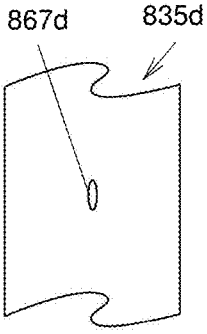
FIG. 59
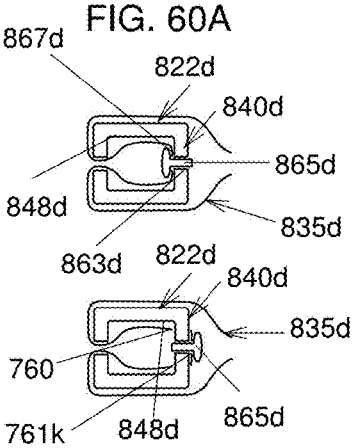
FIG. 60A
FIG. 60B
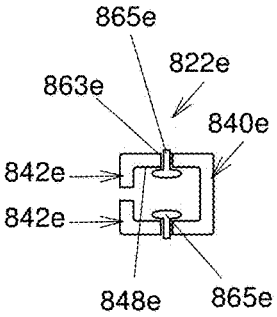
FIG. 62
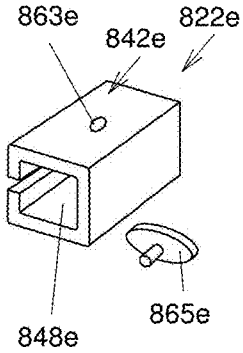
FIG.61
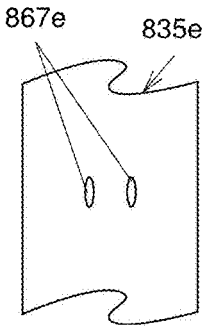
FIG. 63
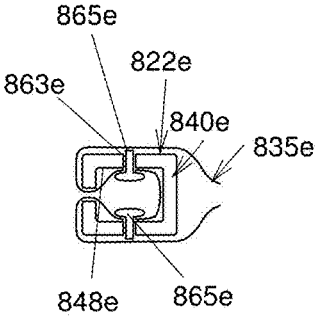
FIG. 64

GARMENT EXTENDER

FIELD OF THE INVENTION

The present invention relates to the general field of clothing, and is more specifically concerned with a garment extender.

BACKGROUND

Garment extenders, for example coat or jacket extenders, are useful for pregnant women, among others. Using such garment extenders, not only can the pregnant woman use the clothes she owns during pregnancy, but she can also use the extended garment to protect a baby carried in a baby carrier after giving birth. One problem with existing garment extenders is that they typically attach to an existing slide fastener, commonly referred to as a zipper, of the garment. Since there are many incompatible slide fasteners types on the market, this requires a large inventory of garment extenders to fit different brands and models of zip fasteners. Also, the buyer of the garment extender has to guess which type of slide fastener is used in the existing garment, or requires the help of a specialized salesperson to select the right type of garment extender that will zip to the existing slide fastener.

Accordingly, there exists a need for an improved garment extender. It is a general objective of the present invention to provide such an improved garment extender.

SUMMARY OF THE INVENTION

In a broad aspect, there is provided a garment extender usable with a garment having a garment slide fastener, the garment slide fastener having a pair of substantially elongated stringer tapes supporting each a row of teeth extending longitudinally therealong, the garment slide fastener also having a slider movable along the rows of teeth in a reciprocating movement for selectively attaching the teeth of both rows to each other when moved in a closing direction and selectively detaching the teeth of both rows from each other when moved in an opening direction opposed to the closing direction, the garment extender comprising an extender body defining substantially opposed extender body first and second side edges and opposed extender body top and bottom edges extending each between the extender body first and second side edges; at least two attachment mounts provided each at a respective one of the extender body first and second side edges; at least two attachments, each mounted to a respective one of the attachment mounts, each of the attachments including an attachment body and a pair of jaws extending from the attachment body, each jaw terminating at a respective jaw free end, the jaws delimiting a channel therebetween opened at both channel ends thereof and the jaw free ends defining a slit therebetween leading to the channel, each jaw defining opposed jaw inner and outer surfaces, the jaw inner surfaces facing each other with the channel therebetween; wherein each attachment mount includes a foldable material, the attachments being more rigid than the foldable material, the attachment being mounted to the attachment mount with the foldable material running along the jaws so that the jaw inner surfaces, outer surfaces and free ends are covered by the foldable material; wherein, with the attachments operatively secured to the garment slide fastener, the slit of each attachment receives thereinto a gripped portion of one of the stringer tapes and the channel of each attachment receives thereinto the teeth that are supported by the stringer tape adjacent the gripped portion, the foldable material being between the jaws inner surfaces and the teeth and between the stringer tapes and the jaw free ends.

There may also be provided a garment extender wherein the attachment body defines a body central portion from which the jaws extend, the foldable material defining a pair of apertures, an inter-aperture portion therebetween and a pair of extra-aperture portions extending away from each other from a respective one of the apertures opposed to the inter-aperture portion, the attachment being mounted to the foldable material with the body central portion inserted through both apertures, the extra-aperture portions each extending from a respective one of the apertures and covering a respective one of the jaws.

There may also be provided a garment extender wherein the extra-aperture portions each extend along a respective one of the jaw inner surfaces, jaw free ends and jaw outer surfaces.

There may also be provided a garment extender wherein a pair of arms extends from the body central portion away from the jaws, at least part of the inter-aperture portion being received between the arms.

There may also be provided a garment extender wherein the extra-aperture portions further extend over the attachment body and are joined to each other so that the attachments are contained in a cavity defined by the foldable material with only the body central portion protruding out of the cavity.

There may also be provided a garment extender wherein the arms are angled so as to converge towards each other in a direction leading away from the body central portion.

There may also be provided a garment extender wherein a prong extends from the body central portion opposed to the jaws, the foldable material defining a prong receiving aperture in the inter-aperture portion, the prong protruding through the prong receiving aperture.

There may also be provided a garment extender further comprising a fastener secured to the prong, the foldable material being secured to the prong between the body central portion and the fastener.

There may also be provided a garment extender further comprising a fastener, the fastener being configured and sized to engage both the attachment and the foldable material so that the foldable material is secured to the attachment.

There may also be provided a garment extender wherein the jaws have bevelled jaw free end portions so that the slit defines flared slit ends.

There may also be provided a garment extender wherein at least one of the jaws has a substantially L-shaped transversal cross-sectional configuration.

There may also be provided a garment extender wherein at least one of the jaws has a substantially arcuate transversal cross-sectional configuration.

There may also be provided a garment extender wherein at least one of the jaws has a substantially rectilinear transversal cross-sectional configuration.

There may also be provided a garment extender wherein the foldable material includes cloth.

There may also be provided a garment extender further comprising a locking clip, the locking clip defining a clip body and a locking portion extending from the clip body, the locking portion being removably insertable in the channel when the attachment is operatively attached to the garment slide fastener, whereby the locking portion increases frictional forces between the attachment mount and the garment slide fastener relative to a configuration in which the locking portion is outside of the channel.

There may also be provided a garment extender wherein the attachment body includes attachment body first and second portions from which a respective one of the jaws extends, the body first and second portions being secured to each other with at least part of the foldable material contained between the body first and second portions.

There may also be provided a garment extender wherein the body first and second portions are secured to each other with at least part of the foldable material pinched between the body first and second portions.

There may also be provided a garment extender wherein the foldable material defines a pinched portion pinched between the body first and second portions and a pair of covering portion extending from the pinched portion, each of the covering portion covering a respective one of the jaws.

There may also be provided a garment extender wherein the body first and second portions and the pinched portion are stitched to each other.

There may also be provided a garment extender wherein the body first portion defines a prong and the body second portion define a prong receiving recess, the prong engaging the prong receiving recess so that the prong is locked in the prong receiving recess to lock the body first and second portions to each other; the prong extends through the pinched portion.

There may also be provided a garment extender wherein an arm extends from the body central portion away from the jaws, at least part of the inter-aperture portion being secured to the arm.

There may also be provided a garment extender wherein the attachment has a substantially C-shaped cross-sectional configuration in a plane substantially perpendicular to the channel.

In another broad aspect, there is provided a garment extender usable with a garment having a garment slide fastener, the garment slide fastener having a pair of substantially elongated stringer tapes supporting each a row of teeth extending longitudinally therealong, the garment slide fastener also having a slider movable along the rows of teeth in a reciprocating movement for selectively attaching the teeth of both rows to each other when moved in a closing direction and selectively detaching the teeth of both rows from each other when moved in an opening direction opposed to the closing direction, the garment extender comprising: an extender body defining substantially opposed extender body first and second side edges and opposed extender body top and bottom edges extending each between the extender body first and second side edges; at least two elongated attachment mounts provided along a respective one of the extender body first and second side edges; a plurality of attachments each mounted to one of the attachment mounts at longitudinally spaced apart locations, each of the attachments including an attachment body and a pair of jaws extending from the attachment body, each jaw terminating at a respective jaw free end, the jaws delimiting a channel therebetween opened at both channel ends thereof and the jaw free ends defining a slit therebetween leading to the channel, each jaw defining opposed jaw inner and outer surfaces, the jaw inner surfaces facing each other and delimiting the channel. With the attachments operatively secured to the garment slide fastener, the slit of each attachment receives thereinto a gripped portion of one of the stringer tapes and the channel of each attachment receives thereinto the teeth that are supported by the stringer tape adjacent the gripped portion.

There may also be provided a garment extender wherein each attachment mount includes a foldable material, the attachments being more rigid than the foldable material, the attachment being embedded at least partially in the foldable material.

Advantageously, in some embodiments, the proposed garment extender may be used with garments having a wide variety of slide fastener dimensions. Also, in some embodiments, the foldable material may provide good friction characteristics so that the garment extender is relatively securely mounted to the slide fastener. The presence of the foldable material may also, in some embodiments, seal the junction between the slide fastener and the garment extender, thereby minimizing or eliminating cold air and moisture infiltration through this junction.

Other objects, advantages and features of the present invention will become more apparent upon reading of the following non-restrictive description of preferred embodiments thereof, given by way of example only with reference to the accompanying drawings.

BRIEF DESCRIPTION OF THE DRAWINGS

In the drawings:

FIG. 14, in a top plan view, illustrates yet another attachment usable in the garment extender of FIG. 2;

FIG. 15, in a perspective view, illustrates an attachment string including a flexible link to which are secured a series of the attachments of FIG. 14;

FIG. 16, in a partial perspective view, illustrates a portion of the attachment string of FIG. 15

FIG. 22, in a front elevation view with parts removed, illustrates part of an alternative garment extender attached to the garment of FIG. 2;

FIG. 23, in a perspective view, illustrates an attachment part of the garment extender of FIG. 22;

FIG. 24, in a top cross-sectional view midway through the attachment of FIG. 23, illustrates the garment extender of FIG. 22;

FIG. 25, in a perspective cross-sectional view, illustrates part of the garment extender of FIG. 22 attached to the garment of FIG. 2;

FIG. 26, in a side elevation view, illustrates an alternative attachment usable in the garment extender of FIG. 25;

FIG. 57, in a perceptive view, illustrates yet another alternative attachment usable in the garment extender of FIG. 22;

FIG. 58, in top cross-sectional view midway therethrough, illustrates the attachment of FIG. 57;

FIG. 59, in a perspective view, illustrates part of an alternative foldable material usable with the attachment of FIGS. 57 and 58;

FIG. 60A, in top cross-sectional view midway through the attachment, illustrates the attachment of FIGS. 57 and 58 mounted to the foldable material of FIG. 59;

FIG. 60B, in top cross-sectional view midway through the attachment, illustrates the attachment of FIGS. 57 and 58 mounted to the foldable material of FIG. 42;

FIG. 61, in a perceptive view, illustrates yet another alternative attachment usable in the garment extender of FIG. 22;

FIG. 62, in top cross-sectional view midway therethrough, illustrates the attachment of FIG. 61;

FIG. 63, in a perspective view, illustrates part of an alternative foldable material usable with the attachment of FIGS. 61 and 62;

FIG. 64, in top cross-sectional view midway through the attachment, illustrates the attachment of FIGS. 61 and 62 mounted to the foldable material of FIG. 63;

FIG. 65, in a perspective view, illustrates yet another alternative attachment usable in the garment extender of FIG. 22;

FIG. 66, in top cross-sectional view midway therethrough, illustrates the attachment of FIG. 65;

FIG. 67, in a perspective view, illustrates part of the foldable material of usable with the attachment of FIGS. 65 and 66 and with the attachment of FIG. 54;

FIG. 68, in top cross-sectional view midway through the attachment, illustrates the attachment of FIGS. 65 and 66 mounted to the foldable material of FIG. 67;

DETAILED DESCRIPTION

The term "substantially" is used throughout this document to indicate variations in the thus qualified terms. These variations are variations that do not materially affect the manner in which the invention works and can be due, for example, to uncertainty in manufacturing processes or to small deviations from a nominal value that do not cause significant changes to the invention. These variations are to be interpreted from the point of view of the person skilled in the art.

Figure 1:
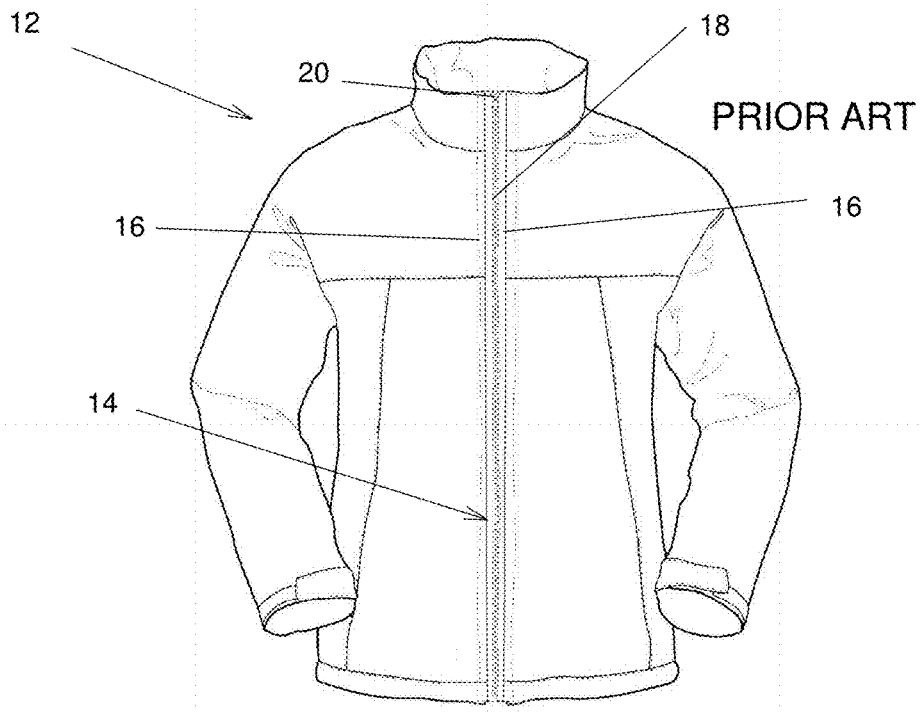
FIG. 1, in a front elevation view, illustrates a garment in the form of a jacket.

FIG. 1 illustrates a conventional garment 12, here shown in the form of a jacket, although alternative garments 12 are within the scope of the appended claims. The garment 12 has a garment slide fastener 14. The garment slide fastener 14 has a pair of substantially elongated stringer tapes 16 supporting each a row of teeth 18 extending longitudinally therealong. The stringer tape 16 is a ribbon of any suitable material, such as, non-limitingly, webbing. The garment slide fastener 14 also has a slider 20 movable along the rows of teeth 18 in a reciprocating movement for selectively attaching the teeth 18 of both rows to each other when moved in a closing direction and selectively detaching the teeth 18 of both rows from each other when moved in an opening direction opposed to the closing direction. Such slide fasteners are conventional and the garment slide fastener 14 is not described in further details herein.

Figure 2:
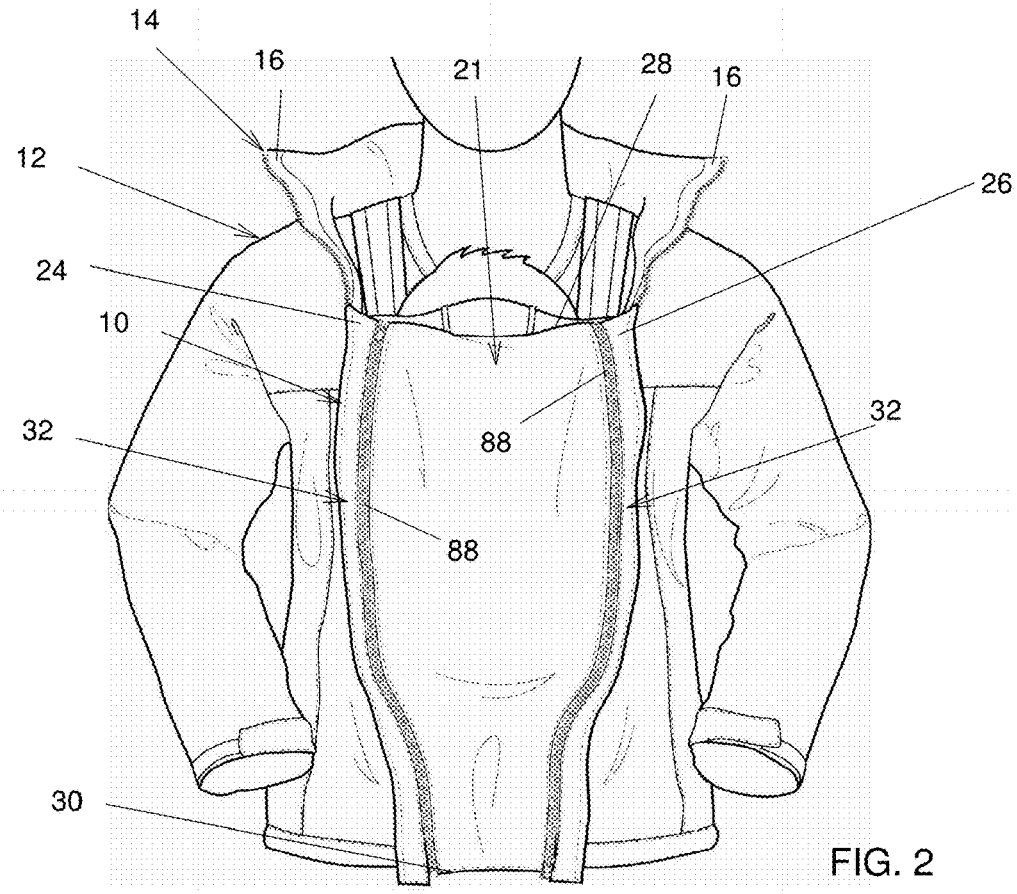
FIG. 2, in a front elevation view, illustrates the garment of FIG. 1 to which is attached a garment extender in accordance with an embodiment of the present invention.

Referring to FIG. 2, a garment extender 10 is attachable to the garment slide fastener 14 to allow extension of the garment 12. For example, the garment extender 10 is usable with a garment 12 in the form of a jacket to leave room for the expanding belly of a pregnant woman or to allow a parent to carry a baby in a baby carrier. However, the garment extender 10 is usable for any other suitable purpose. In some embodiments, the garment extender 10 is attached between spaced apart stringer tapes 16 of the garment slide fastener 14. In other embodiments, for example if the garment extender 10 is used with pants, the stringer tapes 16 are not separated completely along their whole length. Instead, the stringer tapes 16 form a V-shaped gap therebetween in which the garment extender 10 may be positioned (not shown in the drawings).

Figure 3:
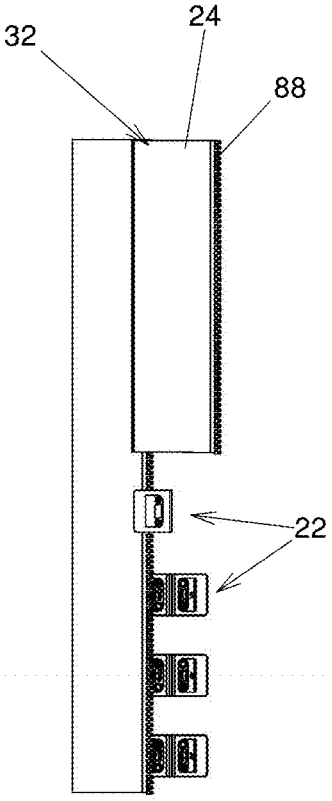
FIG. 3, in a front elevation view with parts removed, illustrates part of the garment extender and garment of FIG. 2.

The garment extender 10 includes a body 21 and at least one attachment 22, some of which are seen for example in FIG. 3. The body 21 includes one or more elements that are positioned in the gap between the stringer tapes 16 of the garment slide fastener 14. In a typical embodiment, the body 21 includes one or more panels of fabric, and, in some embodiment, insulating material. Referring to FIG. 2, The body 21 defines substantially opposed body first and second side edges 24 and 26 and opposed body top and bottom edges 28 and 30 extending each between the body first and second side edges 24 and 26.

Each of the body first and second side edges 24 and 26 is typically provided with at least one respective attachment 22. In some embodiments, each of the body first and second side edges 24 and 26 is provided with a respective plurality of the attachments 22 spaced apart from each other along the body first and second side edges 24 and 26. For example, the attachments 22 are part of two attachment strings 32, each attachment string 32 including attachments 22 linked to each other and secured to one of the body first and second side edges 24 and 26. However, in other embodiments, the attachments 22 are each separately secured to the body 21. In other embodiments, only one attachment 22 is provided at each of the body first and second side edges 24 and 26.

Figure 4:
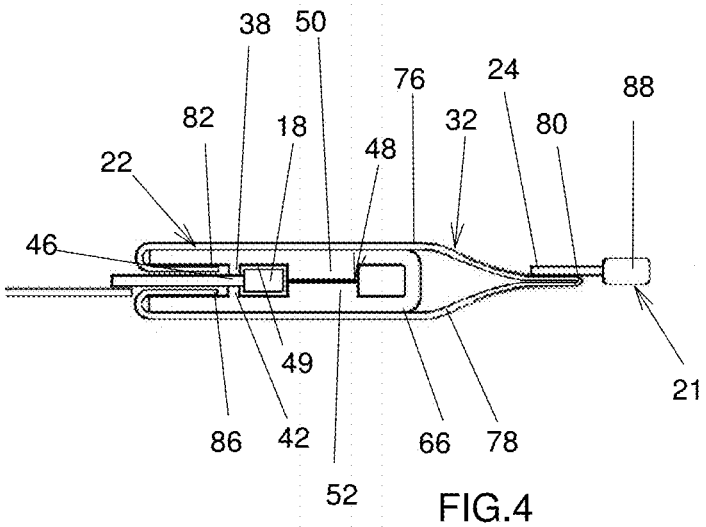
FIG. 4, in a top plan view, illustrates part of the garment and garment extender of FIG. 2.
Figure 5:
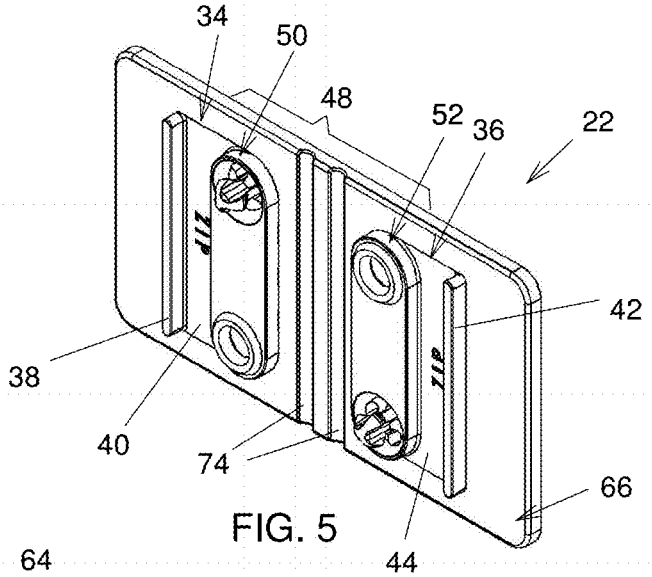
FIG. 5, in a perspective view, illustrates an attachment part of the garment extender of FIG. 2, the attachment being shown in an open configuration.

Referring for example to FIG. 5, each of the attachments 22 includes attachment inside and outside portions 34 and 36. The attachment inside portion 34 includes an inside gripping portion 38 and an inside channel forming portion 40. The attachment outside portion 36 includes an outside gripping portion 42 and an outside channel forming portion 44. As seen in FIG. 4, when the attachment 22 is operatively secured to the garment slide fastener 14, the inside and outside gripping portions 38 and 42 grip a gripped portion 46 of one of the stringer tapes 16 therebetween, and the inside and outside channel forming portions 40 and 44 define a channel 49 receiving thereinto the teeth 18 that are supported by the stringer tape 16 adjacent the gripped portion 46. The attachment 22 thus secures the garment extender 10 to the garment slide fastener 14.

Figure 8:
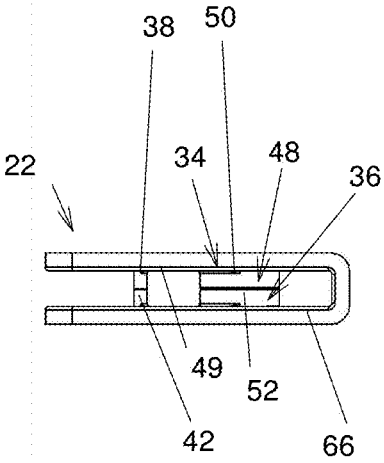
FIG. 8, in a top elevation view, illustrates the attachment of FIG. 5, the attachment being shown in a closed configuration.

Typically, the attachments 22 are removably attachable to the garment slide fastener 14. However, attachments 22 that permanently attach to the garment slide fastener 14 are within the scope of the present invention. In some embodiments, the attachment inside and outside portions 34 and 36 are movable relative to each other between a closed configuration, seen for example in FIG. 8, and an open configuration, seen for example in FIG. 5. The attachment 22 is in the closed configuration when the attachment 22 is attached to the garment slide fastener 14. The inside and outside gripping portions 38 and 42 are spaced apart from each other to a greater extent in the open configuration than in the closed configuration to allow detachment of the attachment 22 from the garment slide fastener 14.

In some embodiments (not shown in the drawings), the attachment inside and outside portions 34 and 36 are biased towards each other towards the closed configuration, for example by being mounted to a spring or other biasing element. In other embodiments, as in the attachment 22 shown in the drawings, each attachment 22 further includes a lock 48 for selectively locking the attachment 22 in the closed configuration. For example, the lock 48 prevents the attachment inside and outside portions 34 and 36 from moving from the closed configuration to the open configuration unless a predetermined force moving the attachment inside and outside portions 34 and 36 away from each other is exerted. In some embodiments, the predetermined force is such that the lock 48 unlocks if forces that could cause damage to the garment slide fastener 14 were exerted on the garment extender 10.

A specific example of the lock 48 includes lock inside and outside elements 50 and 52 provided respectively in the attachment inside and outside portions 34 and 36. The lock inside and outside elements 50 and 52 are complementarily shaped to snap to each other in the closed position. However, in alternative embodiments, any other suitable lock is used. For example, a lock using magnets is within the scope of the invention, magnets of opposing polarity facing each other in the attachment inside and outside portions 34 and 36 in the closed position. In yet other embodiments, the lock includes a biasing element, such as a spring, extending between the attachment inside and outside portions 34 and 36 and biasing the attachment inside and outside portions 34 and 36 towards the closed position.

For the purpose of this document, the term "snap" refers to a structure and an action in which one part defines a recess accessed through an opening narrower than deeper parts of the recess. Another part includes a pin that has a portion that is slightly larger than the opening. At least one of, and in some cases both, the pin and the opening is resiliently deformable so that when a suitable force is exerted pushing the pin into the recess, deformation occurs so that the portion that is slightly larger than the opening is allowed to move past the opening. Then, the pin and opening, reverse at least partially this deformation, with the portion that is slightly larger than the opening received in the recess, which locks the pin in the recess.

In a specific embodiment of the invention, the inside channel forming portion 40 is between the inside gripping portion 38 and lock inside element 50 and the outside channel forming portion 44 is between the outside gripping portion 42 and lock outside elements 52.

In a very specific embodiment of the invention, the attachment inside and outside portions 34 and 36 are formed of a relatively rigid polymer and structured as follows. In this specific embodiment, the attachment inside and outside portions are identical, and only one of them, the attachment inside portion 34, is described in details.

Figure 6:
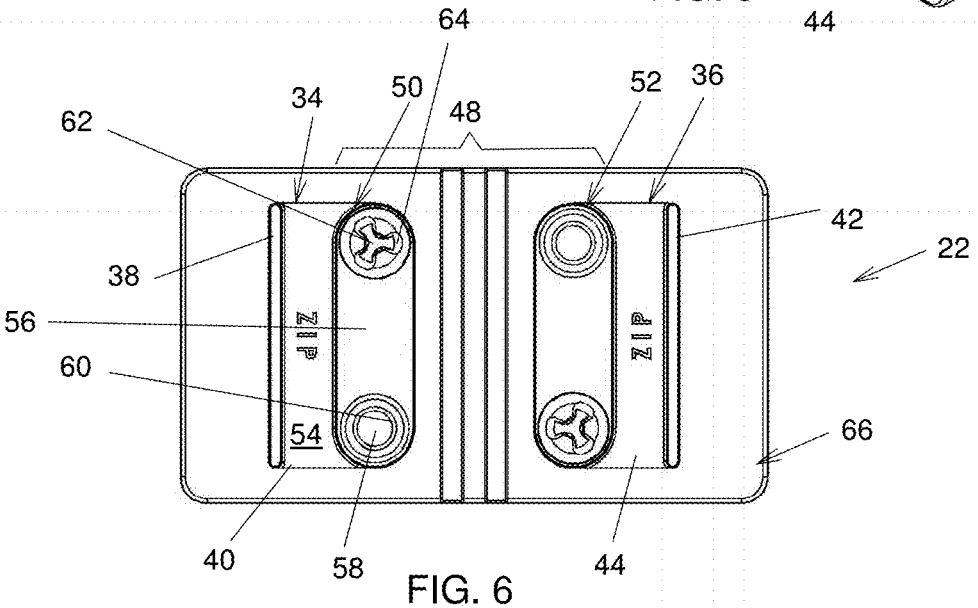
FIG. 6, in a front plan view, illustrates the attachment of FIG. 5.

Referring to FIG. 6, the attachment inside portion 34 includes a base 54, which is for example plate-shaped. The inside gripping portion 38 is a flange extending from the base 54. The flanges of the attachment inside and outside portions 34 and 36 face each other and grip the stringer tape 16 therebetween in the closed configuration. For example, this flange has a length sufficient to extend along a few teeth 18 of the garment slide fastener 14 to distribute stresses exerted on the garment slide fastener 14 over a relatively large portion of the garment slide fastener 14 when the garment extender 10 is in use to reduce possibilities of damaging the garment slide fastener 14.

The lock inside element 50 includes a locking element base 56 extending substantially parallel to the inside gripping portion 38, spaced apart therefrom. The inside channel forming portion 40 is delimited by the locking element base 56 and inside gripping portion 38. In some embodiments, the locking element base 56 and inside gripping portion 38 protrude at about the same height from the base 54.

The lock inside element 50 also includes a recess 58 extending in the base 54, accessed through an opening 60 that is at least slightly narrower than the remainder of the recess 58. Furthermore, the lock inside element 50 includes a prong 62 protruding from the base 54. The prong 62 includes a prong wider portion 64 that is slightly larger than the opening 60. The prong 62 and recess 58 are positioned such that when two of the lock inside elements 50 are positioned so that their inside gripping portions 38 face each other, the prong 62 of one of the lock inside elements 50 faces the recess 58 of the other one of the lock inside elements 50, so that the prongs 62 can engage the recesses 58. The recesses 58 and prongs 62 are configured and sized, and have mechanical properties, such that the above-described snap action occurs when the prongs 62 are pushed into the recesses 58.

In some embodiments, the attachment inside and outside portions 34 and 36 could be each attached, for example using glue, to the body 21. However, in some embodiments, the attachment 22 includes an attachment linking portion 66 (seen in FIG. 6 for example) linking the attachment inside and outside portions 34 and 36 to each other. Such a structure facilitates alignment between the attachment inside and outside portions 34 and 36 to achieve the closed configuration. For example, the attachment inside and outside portions 34 and 36 are more rigid than the attachment linking portion 66. The latter is for example relatively flexible to relatively easily allow movements between the open and closed configurations.

Figure 7:
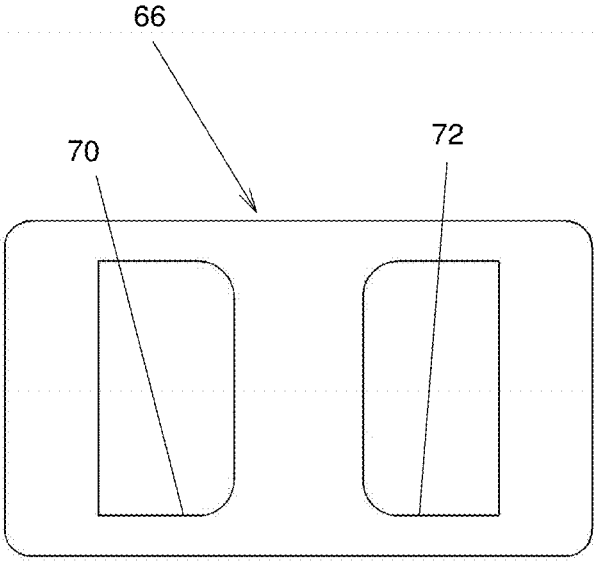
FIG. 7, in a front plan view, illustrates a linking portion part of the attachment of FIG. 5.

Referring to FIG. 7, for example, the attachment linking portion 66 is substantially panel shaped and defines inside and outside portion apertures 70 and 72 respectively receiving the attachment inside and outside portions 34 and 36 (not seen in FIG. 7) thereinto. The attachment linking portion 66 may be made of a polymer overmolded on the attachment inside and outside portions 34 and 36. In some embodiments, as seen in FIG. 6 for example, the attachment linking portion 66 defines at least one groove 74 thereinto, for example two grooves 74, between the inside and outside portion apertures 70 and 72 for facilitating hinging between the attachment inside and outside portions 34 and 36.

In some embodiments, the attachment linking portion 66 is soft enough to allow sewing the attachment linking portion 66 to pieces of fabric. This is advantageous as sewing is a robust and relatively low cost method of attaching components that is well understood in the garment industry.

Referring to FIG. 4, when the attachments 22 are provided in attachment strings 32, the attachment strings 32 may be formed as follows. Each string of attachments includes inside and outside strips 76 and 78, made of a suitable fabric. The inside and outside strips 76 and 78 extend between the attachments 22 and the body 21. The inside and outside strips 76 and 78 may be formed of a single piece of material folded along a fold 80 separating the inside and outside strips 76 and 78 from each other. In alternative embodiments, the inside and outside strips 76 and 78 are made of two different pieces of material. The attachment linking portion 66 of each attachment 22 is secured to the inside and outside strips 76 and 78 and the inside and outside strips 76 and 78 are secured to the body 21. For example, the inside and outside strips 76 and 78 extend generally parallel to each other.

The inside strip 76 has an inside strip side edge 82, opposed to the fold 80 and the outside strip 78 has an outside strip side edges 86, opposed to the fold 80. Adjacent the fold 80, the inside and outside strips 76 and 78 overlap one of the body first and second side edges 24 and 26, the body first side edge 24 being shown in FIG. 4. Part of the body 21 is secured to the inside and outside strips 76 and 78. This layered structure including the inside and outside strips 76 and 78 with part of the body 21 therebetween can be sewn or assembled in any other suitable manner.

The attachments 22 are provided between the inside and outside strips 76 and 78. In some embodiments, the inside and outside strips 76 and 78 are folded over the attachment linking portion 66 adjacent the inside and outside strips side edges 82 and 86 and the layered structure formed of part of one of the inside and outside strips 76 and 78, the attachment linking portion 68 and another part of the same one of the inside and outside strips 76 and 78 is sewn together, or otherwise secured, for example using glue or rivets, among other possibilities.

Figure 13:
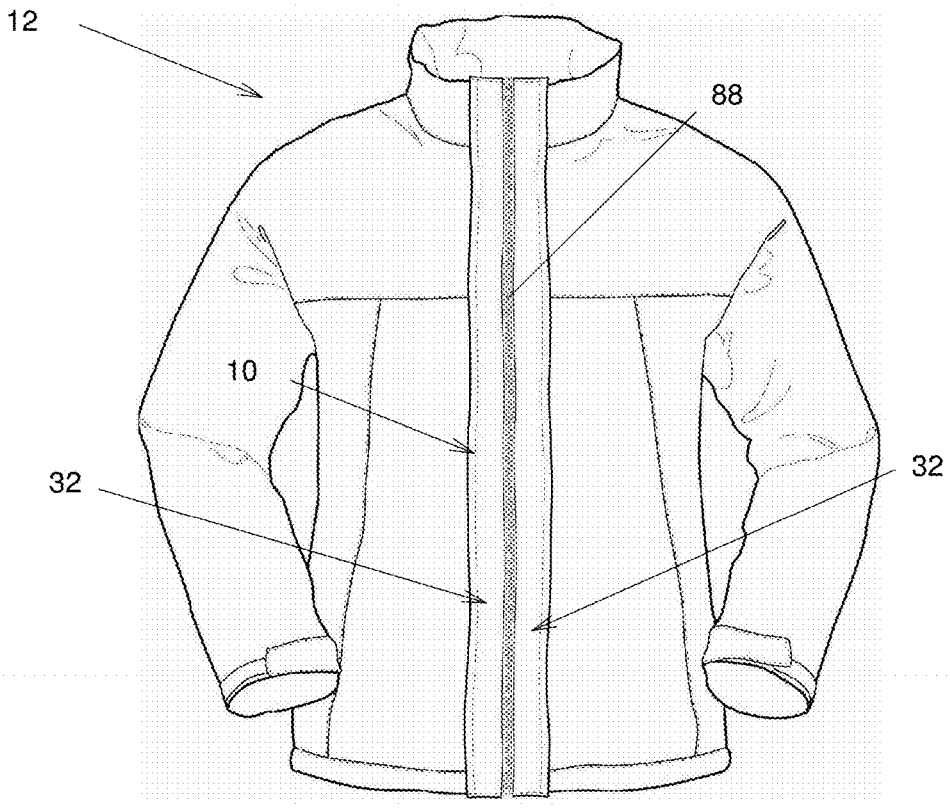
FIG. 13, in a front elevation view, illustrates the garment and garment extender of FIG. 2 with part of the garment extender between two garment slide fasteners removed.

As seen in FIG. 2, in some embodiments, the body 21 is provided with at least one extender slide fastener 88 extending between the body top and bottom edges 28 and 30, which allows opening the garment 12 without removing the garment extender 10. In some embodiments, the garment extender 10 is provided with a pair of laterally spaced apart extender slide fasteners 88 extending between the body top and bottom edges 28 and 30. This allows removal of part of the garment extender 10, the part between the two extender slide fasteners 88, as seen in FIG. 13, while preserving the ability to close and open the garment 12. Also, many different pieces of materials securable to the extender slide fasteners 88 having different widths could be provided to adjust the garment extender 10 to different sizes. In some embodiments, the removable portion includes a wider portion and a narrower portion. When the wider portion is worn over the belly of a pregnant woman, the garment extender 10 may be used to accommodate the expanding belly of the pregnant woman. When the wider portion is worn over the chest of an intended user, which may be achieved by mounting the garment extender 10 upside down with respect to the orientation in which the wider portion is over the belly, a baby carrier carrying a baby may be worn in register with the chest of the intended user and the garment extender 10 may then accommodate the additional volume occupied by the baby and baby carrier.

Figure 9:
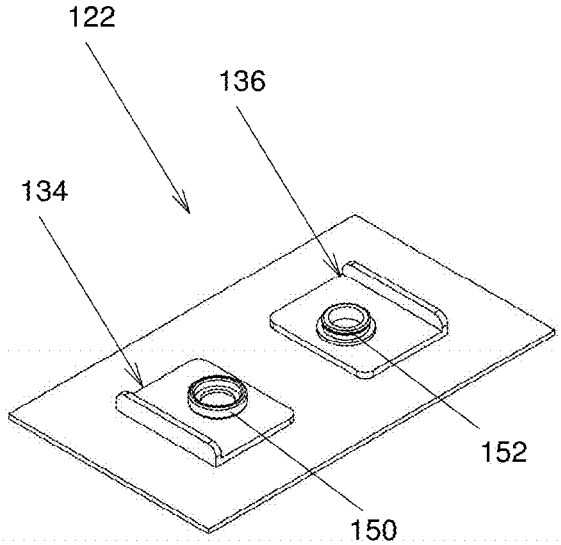
FIG. 9, in a perspective view, illustrates an alternative attachment usable in the garment extender of FIG. 2.
Figure 10:
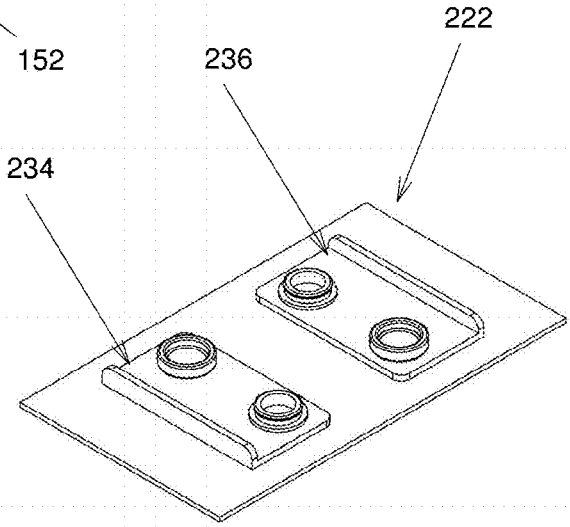
FIG. 10, in a perspective view, illustrates an other alternative attachment usable in the garment extender of FIG. 2.

FIG. 9 illustrates another attachment 122 usable instead of the attachment 22 in the garment extender 10. The attachment 122 differs from the attachment 22 in that the attachment inside and outside portions 134 and 136 have lock inside and outside elements 150 and 152 that differ from the lock inside and outside elements 50 and 52. More specifically, while still employing the "snap" principle, the lock inside and outside elements 150 and 152 don't include the locking element base 56. Instead, the lock inside and outside elements 150 and 152 have a structure similar to that of a conventional push button used commonly in the garment industry. Also, the attachment inside and outside portions 134 and 136 are not identical as they each include a single element part of the conventional push button structure, which need to be complementarily shaped to the other element of the conventional push button structure. In alternative embodiments, the same push button structures are used, but two of them are present on each of the attachment inside and outside portions 234 and 236, as seen in FIG. 10 for the attachment 222.

Figure 11:
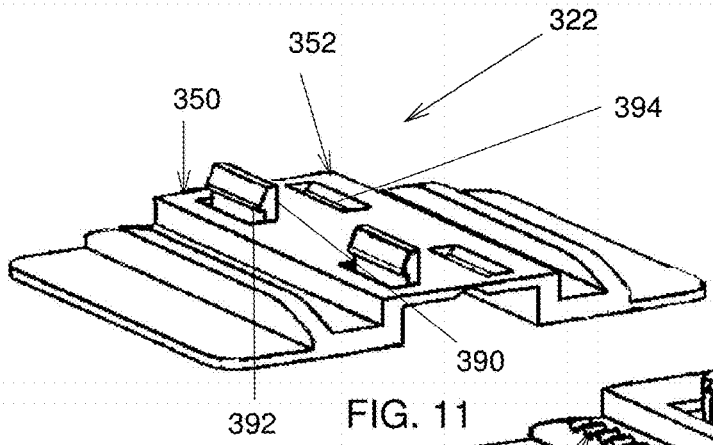
FIG. 11, in a perspective view, illustrates yet an other alternative attachment usable in the garment extender of FIG. 2.

FIG. 11 illustrates yet another attachment 322 usable instead of the attachment 22 in the garment extender 10. The attachment 322 differs from the attachment 22 in that the lock inside and outside elements 350 and 352 differ from the lock inside and outside elements 50 and 52. One of the lock inside and outside elements 350 and 352 include at least one deformable elongated tongue 390 provided with a ledge 392 generally transversal to the tongue 390. The tongue 390 is insertable in a recess 394 of the other one of the lock inside and outside elements 350 and 352 by resiliently deforming the tongue 390 until the tongue 390 has been inserted enough that it can spring back to its undeformed configuration with the ledge 392 abutting against a correspondingly shaped portion of the recess 394 so that removal of the tongue 390 from the recess 394 requires deformation of the tongue 390 to retract the ledge 392 so that the later can be retracted from the recess 394. In other embodiments, the tongue 390 deforms enough to be removed from the recess 394 when enough pulling force is exerted thereonto. The attachment 322 includes a pair of tongues 390 and recess 394.

Figure 12:
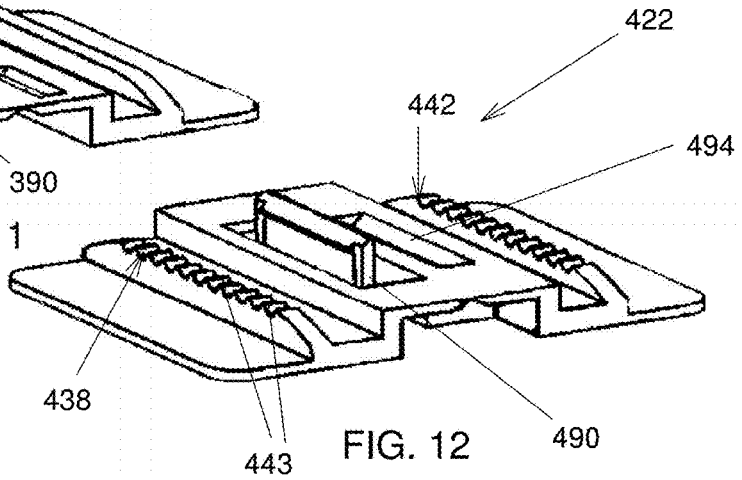
FIG. 12, in a perspective view, illustrates yet an other alternative attachment usable in the garment extender of FIG. 2.

FIG. 12 illustrates yet another attachment 422 usable instead of the attachment 22 in the garment extender 10. The attachment 422 is similar to the attachment 322 except that it includes only one tongue 490 and one recess 494, which are longer than the tongue 390 and recess 394. Also, the attachment 422 includes inside and outside gripping portions 438 and 442 that are provided with teeth 443 to better grip the stringer tapes 16.

Figure 17:
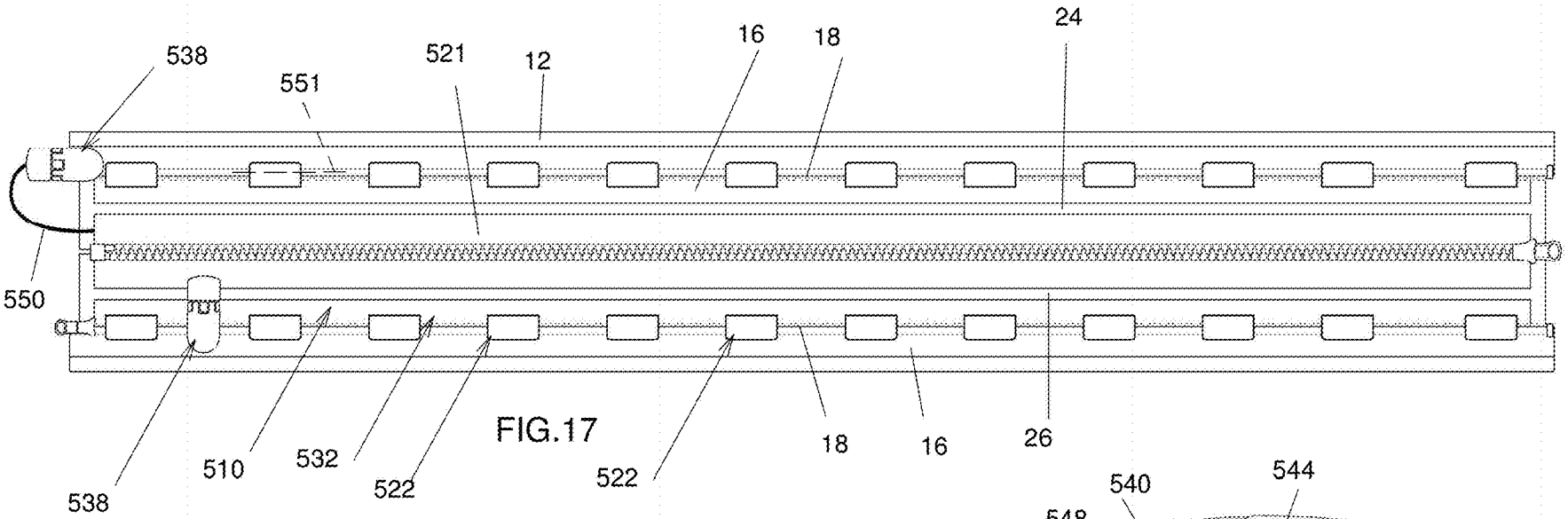
FIG. 17, in a rear elevation view, illustrates part of the garment of FIG. 2 and a garment extender similar to the garment extender of FIG. 2, in which the attachments are the attachments of FIG. 14 linked to each other in the attachment string of FIGS. 15 and 16, with a part of the garment extender between two garment slide fasteners removed.

FIGS. 14 to 20 present various aspects related to yet another attachment 522 usable instead of the attachment 22 in an alternative garment extender 510, the latter being shown in FIG. 17. Typically, but not necessarily, a plurality of attachments 522 are used to secure the body 521 to the garment 12, as in the garment extender 10. The attachments 522 could be individually secured to the body 521, for example using stitches, rivets or an adhesive. However, in some embodiments, the attachments 522 are linked to each other in an attachment string 532 through a flexible link 533, as shown in FIG. 15 for example and further described hereinbelow.

Referring to FIG. 16, each of the attachments 522 defines a channel 549 defining a channel axis 551 extending substantially parallel to one of the body first and second side edges 24 or 26 at which the attachment 522 is provided, as seen in FIG. 17. Returning to FIG. 16, each of the attachments 522 also define a slit 553 parallel to the channel axis 551 and leading laterally into the channel 549 along the whole channel 549. As seen in FIG. 14, the slit 553 of each attachment 522 faces away from the body 521.

As seen in FIG. 16, each slit 553 is defined between a pair of slit edges 555 and 557. Each slit 553 defines axially opposed slit end portions 559 and 561 and a slit intermediate portion 563 therebetween. At least one of the slit edges 555 and 557, for example both slit edges 555 and 557 as seen in FIG. 16, is bevelled in the slit end portions 559 and 561 so that an axial access to the slit 553 is tapered towards the slit intermediate portion 563. This configuration facilitates sliding the attachments 522 along the stringer tapes 16.

In some embodiments, the attachments 522 may be slightly flexible so that the slit 553 may be widened slightly against a biasing force forcing the slit edges 555 and 557 away from each other when the stringer tape 16 is inserted thereinto, so that the attachments 522 engage the stringer tape 16 with a small axial friction force. In other embodiments, the slits 553 are be wider than the typical thickness of the stringer tape 16.

As seen in FIG. 14, the attachments 522 may have a substantially C-shaped transversal cross-sectional configuration. With the attachments 522 operatively secured to the garment slide fastener 14, the slit 553 of each attachment 522 receives thereinto a gripped portion 46 of one of the stringer tapes 16 therebetween and the channel 549 of the attachment 522 receives thereinto the teeth 18 that are supported by the stringer tape 16 adjacent the gripped portion 46.

It should be noted that in opposition to the attachments 22, the attachments 522 typically don't grip the stringer tapes 16 with a large force, but are movable therealong by exerting a relatively small force. Thus, the gripping force is such that friction between the attachments 522 and the stringer tapes 16 is relatively low. As described hereinbelow, in some embodiments, a clip 538 (seen in FIG. 17 for example) is used to prevent the attachments 522 from sliding out of the stringer tape 16. However, in alternative embodiments, the attachments 522 grip the stringer tape 16 with enough force that the clip 538 is not required. Also, the channel 549 has a transversal cross-sectional configuration such that the teeth 18 of commercially available slide fasteners 14 may be freely received thereinto with minimal or no friction.

To ensure that the teeth 18 cannot exit the attachment 522 through the slit 553, the latter has a relatively narrow width, and, when the attachments 522 are deformable, the attachment 522 is rigid enough to prevent excessive deformation that would allow such movement of the teeth 18 through the slit 553.

With reference to FIG. 15, the attachments 522 provided at at least one of the body first and second side edges 24 and 26, and typically at both of the body first and second side edges 24 and 26, are linked to each other in an attachment string 532 through a flexible link 533. Typically, the flexible link 533 is less rigid than the attachments 522. The attachments 522 are secured to the flexible link 533 in any suitable manner. For example, the attachments 522 are glued to the flexible link 533. In other embodiments, the attachments 522 define a peripherally extending flange (not shown in the drawings) that is embedded in the flexible link 533, for example by overmolding that latter over the attachments 522, and more specifically the flanges. Any other suitable manner of securing the attachments 522 to the flexible link 533 is also within the scope of the invention.

As seen in FIG. 14, the attachment string 532 may be secured to a strip 576 part of the body 521 and extending parallel to the flexible link 533, similarly to the use of the strips 76 and 78 in the garment extender 10. The strip 576 may be folded over itself at one strip side edge 582 thereof to form a fold 581 folding over the flexible link 533. The folded strip 576 may be secured in any suitable manner to the flexible link 533, for example using stitches, rivets or an adhesive, among other possibilities.

Figure 18:
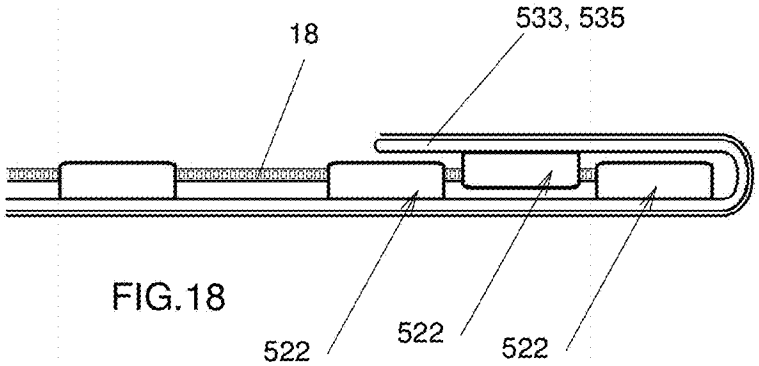
FIG. 18, in a side elevation view, illustrates the attachment strip of FIGS. 15 and 16 with the flexible link folded over itself at a link end thereof.

The attachments 522 include two opposed end attachments 522 and intermediate attachments 522 provided therebetween. In some embodiments, as seen in FIG. 18, with the flexible link 533 folded over itself adjacent one link end 535 thereof, the end attachment 522 adjacent to that link end 535 is insertable between two adjacent ones of the intermediate attachments 522. This is possible if the spacing between the end attachment 522 and the intermediate attachment 522 to which it is adjacent is large enough to allow such a fold and if the distance between the two intermediate attachments is larger than the length of the end attachment 522. This ability to fold over the attachment string 532 and insert the end attachment 522 between two intermediate attachments 522 is useful to shorten the attachment string 532 so that the attachment string 532 can be used with garment slide fasteners 14 of different lengths. Indeed, the folded over portion can be maintained folded by simply engaging the stringer tape 16 between the two intermediate attachments 522 with the end attachment 522.

In some embodiments, a clip 538 is provided, as seen in FIG. 17. The clip 538 is operable for gripping the stringer tape 16. When the clip 538 grips the stringer tape, the attachment string 532, and therefore the attachments 522 may be maintained at a fixed location relative thereto. This functionality may be achieved in many alternative manners. Two such manners are illustrated in FIG. 17. It should be noted that in some embodiments, only one of these manners is implemented, at one or both sides of the garment extender 510.

Figure 20:
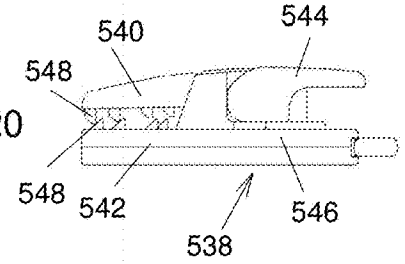
FIG. 20, in a side elevation view, illustrates the clip of FIG. 19, the clip being shown in a closed configuration.
Figure 19:
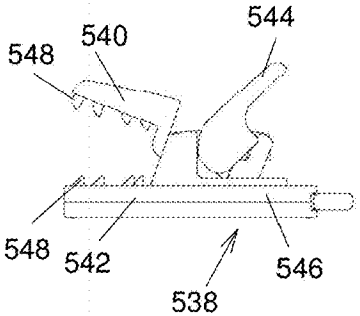
FIG. 19, in a side elevation view, illustrates a clip usable in conjunction with the attachments of FIG. 14, the clip being shown in an open configuration.

FIGS. 19 and 20 illustrate the clip 538. The clip 538 is movable between open and closed configurations, shown respectively in FIGS. 19 and 20. The clip 538 includes a pair of jaws 540 and 542 that are adjacent to each other in the closed configuration, and spaced apart from each other in the open configuration. The jaws 540 are operated using levers 544 and 546 extending respectively from the jaws 540 and 542. The lever 546 extends integrally from the jaw 542 in the embodiment of the clip 538 shown in FIGS. 19 and 20, but other types of levers are within the scope of the invention. The jaws 540 and 542 may be biased towards the closed configuration, for example using a biasing element, or the clip 538 may be configured so that when the jaws 540 and 542 are in the closed configuration, a minimal force is required to achieve the open configuration, so that the jaws are maintained in the closed configuration unless this minimal force is exerted. The jaws 540 and 542 may also be provided with protrusions 548 configured to engage or penetrate any piece of fabric or any soft material provided between the two jaws 540 and 542. Examples of suitable clips 538 are provided in U.S. Pat. No. 8,806,726 issued Aug. 19, 2014 to Tien Chung Ent Co Ltd and in U.S. Pat. No. 7,979,965 issued Jul. 19, 2011 to Tien Chung Ent Co Ltd, the contents of which are hereby incorporated by reference in their entirety. However, any other suitable clip may be used.

Referring to FIG. 17, the clip 538 may be secured to the remainder of the garment extender 510 in many different manners. For example, as shown for the bottom clip 538 in FIG. 17, the clip 538 is secured to one of the body 521 and flexible link 533 between two adjacent ones of the attachments 522. In FIG. 17, the clip 538 is secured to the body 521 with the jaws 540 and 542 positioned between two attachments 522. With the garment extender 510 operatively secured to the garment 12 (only partially shown in FIG. 17), the clip 538 is operable for selectively and reversibly gripping one of the stringer tapes 16 between the two adjacent ones of the attachments 522. When this is achieved, the attachments 522 are prevented from sliding along the stringer tapes 16 accidentally.

Another manner of providing the clip 538 is illustrated for the top clip 538 of FIG. 17. The clip 538 is secured to the body 521, for example using a small piece of rope 550, one end of which being secured to the body 521, and the other end of which being secured to the clip 538. Thus, this clip 538 may be moved relative to the remainder of the garment extender 510. The rope 550 is positioned and configured so that with the garment extender 510 operatively secured to the garment 12, the clip 538 is operable for selectively and reversibly gripping jointly one of the flexible links 533 and one of the stringer tapes 16 adjacent to the one of the flexible link 533. Indeed, in this configuration, when the attachments 522 receive therebetween the stringer tape 16, the stringer tape 16 and flexible link 533 run parallel and adjacent to each other. The clip 538 can therefore receive between its jaws 540 and 542 the stringer tape 16 and flexible element 533, for example at the top or bottom ends thereof.

While each side of the garment extender 510 is provided with only one clip 538 in FIG. 17, it is within the scope of the invention to provide more than one clip 538 for each side of the garment extender 510, for example one adjacent the top of the garment extender 510, and one adjacent the bottom of the garment extender 510, among other possibilities.

In use, the garment extender 510 is secured to the garment 12 by simply aligning the teeth 18 of one half of the slide fastener at one end thereof with one of the channels 549 of one of the end attachments 522 and pulling this end attachment 522 along the stringer tape 16. As they reach the stringer tape 16, the other attachments 522 may be automatically aligned with the stringer tape 16 if the flexible link 533 has enough rigidity, or may need a bit of adjustment by the intended user to be suitably aligned to suitably engage the stringer tape 16 with the teeth 18 positioned in the channel 549. If needed, the flexible link 533 is folded over itself when the end of the attachment string 532 is reached so that the end attachment 522 can be suitably positioned to achieve the configuration of FIG. 18. Then, the clip 538 is used to ensure that the attachments 522 remain fixed relative to the garment 12. The other half of the garment extender 510 can be simultaneously secured to the garment 12 with the first half. In other embodiments, when the garment extender 510 includes two portions that can be detached from each other, each portion can be secured individually to the garment 12, followed by attachment to each other of the two separated portions.

Figure 21:
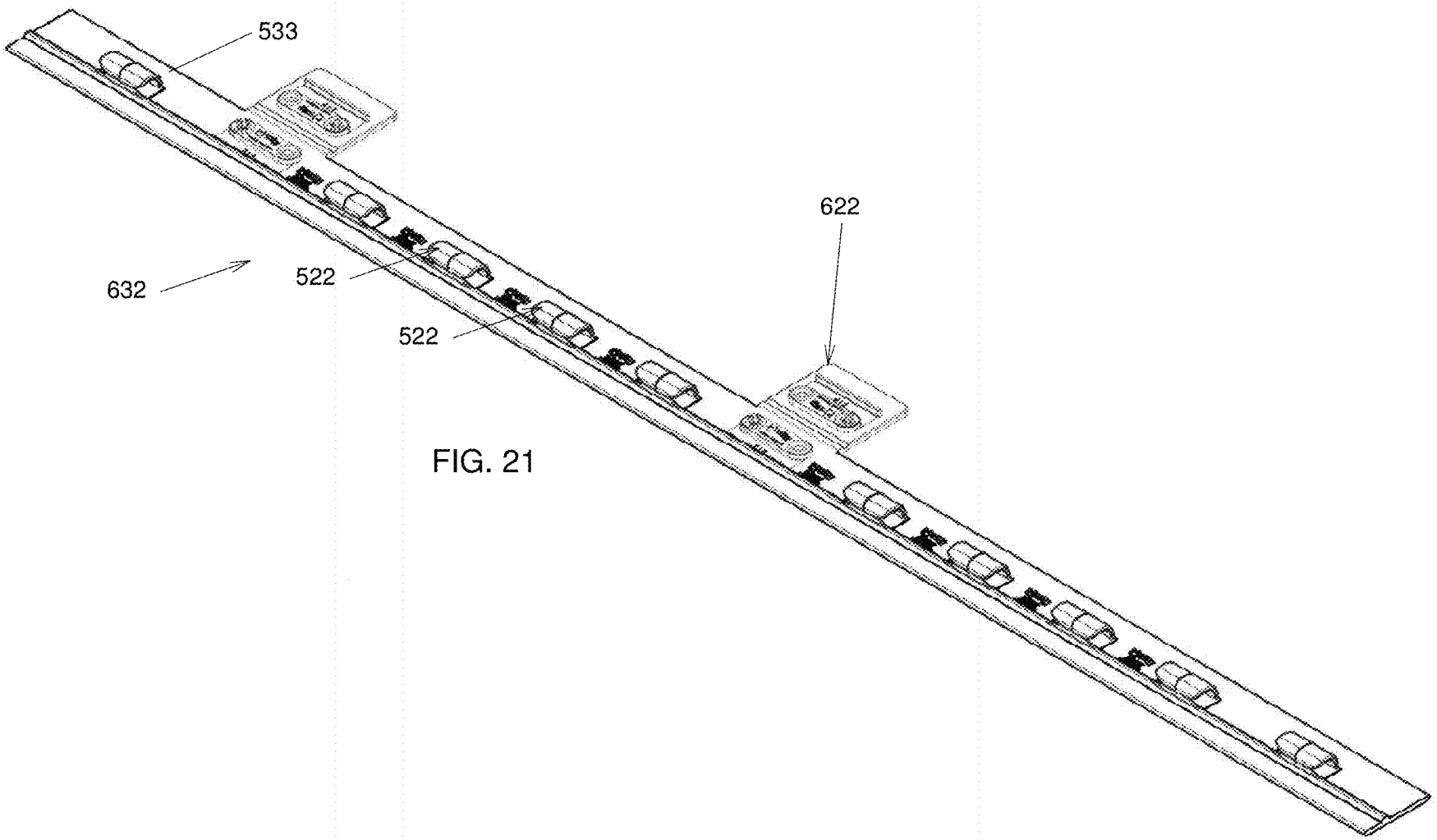
FIG. 21, in a perspective view, illustrates an attachment string in accordance with another embodiment of the present invention.

FIG. 21 illustrates another attachment string 632 usable in the garment extender 510 instead of the attachment string 532. The attachment string 632 is very similar to the attachment string 532 except that it also includes a fixation attachment 622, which is similar in shape and function to the attachments 22, 122, 222, 322 and 422. The fixation attachment 622 is secured to the flexible link 533 along the line defined by the attachments 522 in any suitable manner, for example through overmolding or use of an adhesive, among other possibilities. The attachment string 632 includes two fixation attachments 622, but attachment strings 632 including only one fixation attachments 622 or more than two fixation attachments 622 are also possible. In use, the attachment string 632 is used similarly to the attachment string 532, except that when the attachment string 632 is properly positioned, the fixation attachment 622 is closed to securely grip the stringer tape 16. In such embodiments, the clips 538 may not be required and may be omitted.

In alternative embodiments, referring to FIG. 22, attachment strings 732 include attachments 722 that are mounted to attachment mounts 733. Attachment mounts 733 are, for example, provided each at a respective one of the extender body first and second side edges 24 and 26 (only the first one being shown in FIG. 22). The attachment strings 732 are usable with any suitable body 21 and 521 described hereinabove, or with any other suitable alternative body.

The attachments 722 are at least partially embedded in a foldable material 735 part of the attachment mounts 733. In some embodiments, the attachment mounts 733 are entirely made of the foldable material 735, but in other embodiments, the attachment mount 733 may include other elements. The attachments 722 are more rigid than the foldable material 735. For example, the foldable material 735 includes a cloth or fabric. In some embodiments, most of or all the parts of the attachment 722 that are exposed to the intended user of the attachment string 732 are covered by the foldable material 735. Advantageously, this improves the aesthetics of the attachment string 732. Also, since the attachment strings 732 may be used in a baby carrying context, this configuration may protect a carried baby from exposure to relatively rigid and irritating attachments 722. Furthermore, the foldable material 735 may improve the seal between the attachment string 732 and the slide fastener 14, reducing cold air infiltration in the garment 12. The foldable materials, such as foldable material 735, used in garment extenders described hereinbelow is represented schematically as a single line, with no thickness, to reduce clutter in the drawings and facilitate understanding of the structure of the garment extender. However, the foldable material 735 and all the other foldable materials may have any suitable thickness.

The attachments 722, and all the other attachments described hereinbelow, may be slightly flexible, similarly to the attachment 522, or may be stiffer so as to deform with difficulty in normal use. Also, similarly to the attachment 22, the attachments 722, and the other attachments described hereinbelow, may be used individually, in other words one attachment 722 attached to the garment slide fastener 14, or in a plurality, in the attachment string 732.

Referring to FIG. 23, the attachment 722 includes an attachment body 740 and a pair of jaws 742 extending from the attachment body 740, each jaw 742 terminating at a respective jaw free end 746. The jaws 742 delimit a channel 748 therebetween opened at both channel ends thereof and the jaw free ends 746 define a slit 750 therebetween leading to the channel 748. In that respect, the attachment 722 acts similarly to the attachment 522 described hereinabove. Each jaw 742 defines opposed jaw inner and outer surfaces 752 and 754, the jaw inner surfaces 752 facing each other and delimiting the channel 748. Typically, the channel 748 is wider than the slit 750.

Referring to FIG. 24, each attachment mount 733 includes a foldable material 735, and is typically made entirely of the foldable material 735. The foldable material 735 may be formed by a single continuous sheet of the foldable material 735, or by many such sheets secured to each other and to the attachment 722. The attachments 722 are mounted to the attachment mount 733 with the foldable material 735 running along the jaws 742 so that the jaw inner surfaces, outer surfaces and free ends 752, 754 and 746 are covered by the foldable material 735.

With the attachments 722 operatively secured to the garment slide fastener 14, the slit 750 of each attachment 722 receives thereinto a gripped portion 46 of one of the stringer tapes 16 and the channel 748 of each attachment 722 receives thereinto the teeth 18 that are supported by the stringer tape 16 adjacent the gripped portion 46. The foldable material 735 is present between the jaws inner surfaces 752 and the teeth 18 and between the stringer tape 16 and the jaw free ends 746. In such embodiments, the foldable material 735 may increase friction between the attachment string 732 and the stringer tape 16 so that the attachment string 732 grips the stringer tape 16 better than in the case in which similar attachments 722 are not covered with the foldable material 735.

In a specific embodiment of the invention, the attachment body 740 defines a body central portion 758 from which the jaws 742 extend. For example the body central portion 758 is substantially plate-shaped and perpendicular to the jaws 742, but any other suitable configuration is within the scope of the invention. The foldable material 735 defines a pair of apertures 760, an inter-aperture portion 762 therebetween and a pair of extra-aperture portions 764 extending away from each other from a respective one of the apertures 760 opposed to the inter-aperture portion 762. The attachments 722 are mounted to the foldable material 735 with the body central portion 758 inserted through both apertures 760, the extra-aperture portions 764 each extending from a respective one of the apertures 760 to cover a respective one of the jaws 742. More specifically, the extra-aperture portions 764 each extend along a respective one of the jaw inner surfaces 752, jaw free ends 746 and jaw outer surface 754.

In some embodiments, a pair of arms 766 extend from the body central portion 758 away from the jaws 742 and at least part of the inter-aperture portion 762 is received between the arms 766. Also, in some embodiments, the extra-aperture portions 764 further extend over the attachment body 740 and are joined to each other so that the attachments 722 are contained in a cavity 768 defined by the foldable material with only the body central portion 758 protruding out of the cavity 768. Since the body central portion 758 is in the channel 748, in use, when attached to a garment 12, the attachments 722, which are typically made of a suitable polymer or metal, have no exposed part and therefore present a more pleasing aesthetic aspect and cannot directly contact skin or other surfaces. In such embodiments, the extra-aperture portions 764 may be sewn together, along with the body 21 at one of the body first and second side edges 24 and 26, thereby securing the attachment string 732 to the body 21. In some embodiments, the foldable material 735 has one end portion thereof folded over the other one prior to sewing to the body 21.

Figure 27:
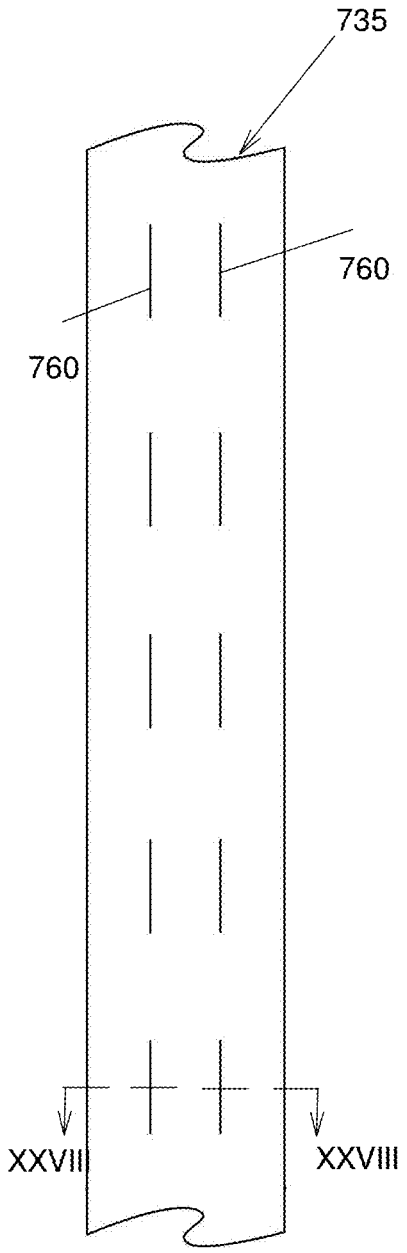
FIG. 27, in a partial top plan view, illustrates a foldable material part of the garment extender of FIG. 22, here shown prior to assembly of the garment extender.

FIGS. 27, 28A to 28E and 24 illustrate a method of attaching the attachments 722 to the foldable material 735. FIG. 27 illustrates the foldable material 735 in the form of a piece of cloth into which pairs of apertures 760 have been formed, which are slit-shaped for example. The pairs of apertures 760 have been provided at longitudinally spaced apart locations along the foldable material 735. Each pair of apertures 760 is used to mount a respective attachment 722 to the foldable material 735.

Figure 28A:
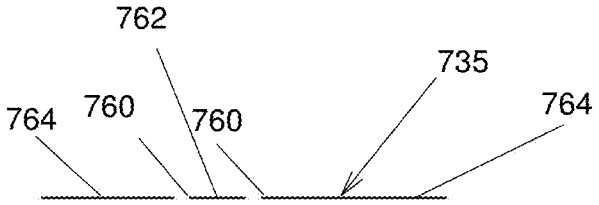
FIG. 28A, in a schematic top cross-sectional view, illustrates a step performed when mounting the attachment of FIG. 23 to the foldable material of FIG. 27.
Figure 28B:
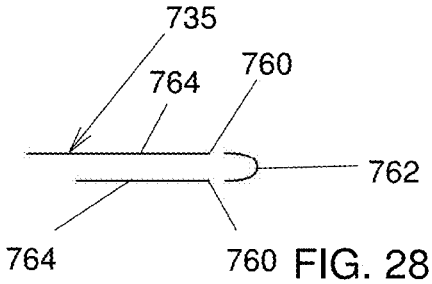
FIG. 28B, in a schematic top cross-sectional view, illustrates another step performed when mounting the attachment of FIG. 23 to the foldable material of FIG. 27.
Figure 28C:
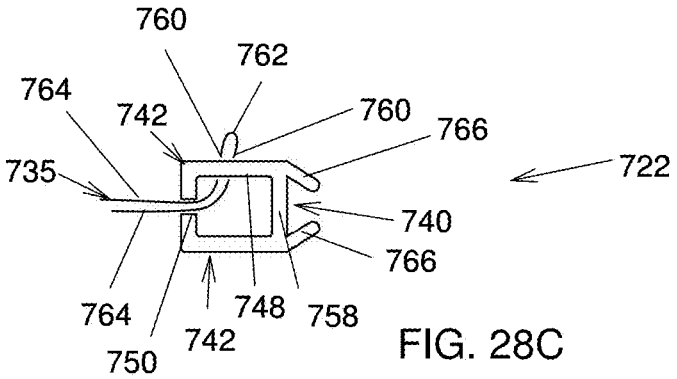
FIG. 28C, in a schematic top cross-sectional view, illustrates yet another step performed when mounting the attachment of FIG. 23 to the foldable material of FIG. 27.
Figure 28D:
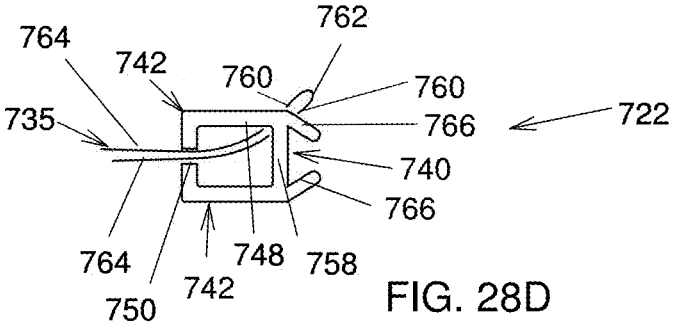
FIG. 28D, in a schematic top cross-sectional view, illustrates yet another step performed when mounting the attachment of FIG. 23 to the foldable material of FIG. 27.
Figure 28E:
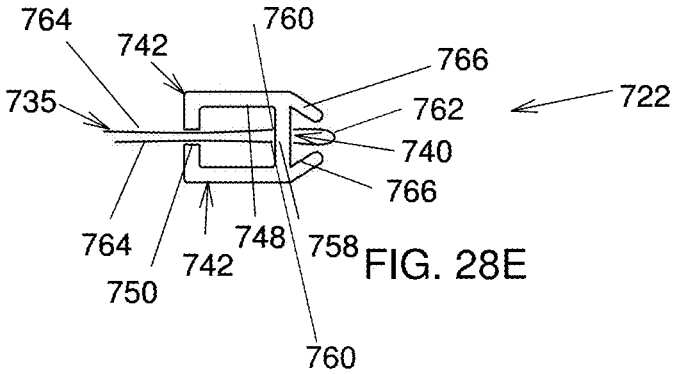
FIG. 28E, in a schematic top cross-sectional view, illustrates yet another step performed when mounting the attachment of FIG. 23 to the foldable material of FIG. 27.

As seen in a schematic cross-section along line XXVIII-XXVIII of FIG. 27, the foldable material 735 is first laid flat, as shown in FIG. 28A, and then folded over itself in the inter-aperture portion 762, as seen in FIG. 28B, for example along the whole length of the foldable material 735, so that the apertures 760 within each pair are in register with each other. Then, one of the jaws 742 is inserted through both apertures 760. The foldable material 735 is then slid over the whole jaw 742, as seen in FIG. 28D and over one of the arms 766, as seen in FIG. 28E, until the inter-aperture portion 762 is located between the two jaws 742. Subsequently, the extra-aperture portions 764 are folded over the jaw outer surfaces 754 and joined to each other and to the body 21, for example using stitches, as seen in FIG. 24. It should be noted that this manner of manufacturing the attachment string 32 uses no glue and no fastener, and only a single piece of foldable material 735. It can therefore be efficiently implemented for mass production.

The attachments 722 may have a uniform cross-sectional configuration along their whole length, in other words along the channel 748, so that they can be manufactured by cutting a suitably shaped extrusion at regular intervals. In other embodiments, as seen in FIG. 26, the slit 750*a* of an alternative attachment 722*a* is flared at both ends 753*a* thereof, similarly to the attachment 522. Other suitable configurations are also within the scope of the invention. Many alternatives to the attachment 722 are described hereinbelow. Only the differences between these alternatives and the attachment 722 are described in details and it should be assumed that unless otherwise mentioned, an alternative is to be presumed to work similarly to the base embodiment to which it is compared.

Figure 37:
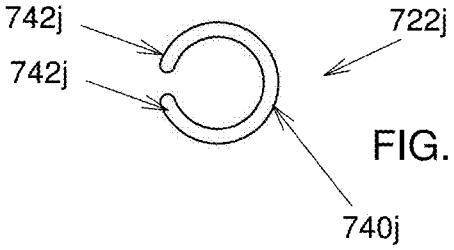
FIG. 37, in a top elevation view, illustrates yet another alternative attachment usable in the garment extender of FIG. 22.

The attachment 722 has a pair of jaws that each have a substantially L-shaped transversal configuration, with two proximal portions extending from the attachment body 740 parallel to each other and distal portions extending perpendicular to the proximal portions and towards each other to define the slit 750. However, in other embodiments, as seen for example respectively for attachments 722*b* and 722*j* in FIGS. 33 and 37, one of both of the jaws 742*b* and 742*j* has a substantially arcuate transversal cross-sectional configuration. In the latter case, both jaws 742*j* and the attachment body 740*j* are arcuate, so that the attachment 722*j* as a whole has a substantially arcuate configuration, traversing most of a circle. In the case of the attachment 722*b* the other jaw 743*b* has a substantially rectilinear transversal cross-sectional configuration.

Figure 33:
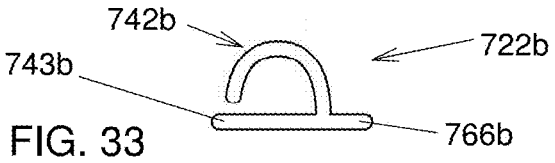
FIG. 33 in a top elevation view, illustrates yet another alternative attachment usable in the garment extender of FIG. 22.
Figure 34:
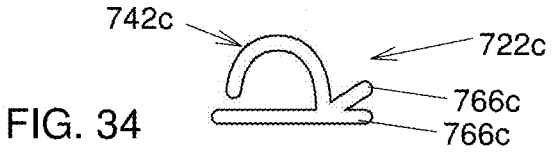
FIG. 34, in a top elevation view, illustrates yet another alternative attachment usable in the garment extender of FIG. 22.
Figure 35:
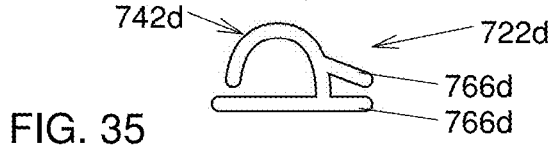
FIG. 35, in a top elevation view, illustrates yet another alternative attachment usable in the garment extender of FIG. 22.
Figure 36:
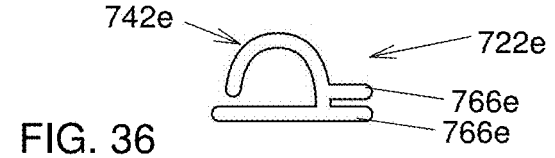
FIG. 36, in a top elevation view, illustrates yet another alternative attachment usable in the garment extender of FIG. 22.
Figure 29:
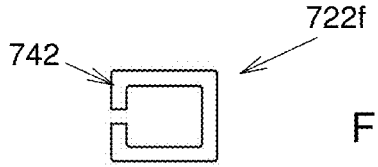
FIG. 29, in a top elevation view, illustrates another alternative attachment usable in the garment extender of FIG. 22.
Figure 30:
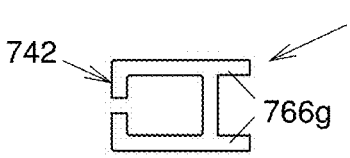
FIG. 30, in a top elevation view, illustrates yet another alternative attachment usable in the garment extender of FIG. 22.
Figure 31:
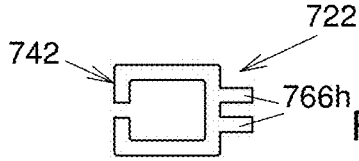
FIG. 31, in a top elevation view, illustrates yet another alternative attachment usable in the garment extender of FIG. 22.
Figure 32:
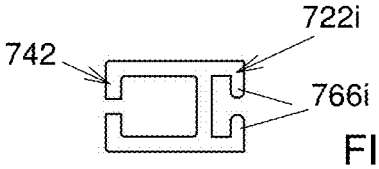
FIG. 32, in a top elevation view, illustrates yet another alternative attachment usable in the garment extender of FIG. 22.

The arms 766 may also have various configurations. In the attachment 722, as seen in FIG. 23, the arms 766 are rectilinear and are angled so as to converge towards each other in a direction leading away from the body central portion 758. However, as seen for attachment 722*f* of FIG. 29, the arms 766 may be omitted in some embodiments. In other embodiments, as seen for attachment 722*g* and 722*h* of respectively FIGS. 30 and 31, the arms 766*g* and 766*h* may be rectilinear and parallel to each other. The arms 766*g* extend each opposed and in register with a respective one of the jaws 742, or may be located inwardly relative to the jaws 742. In yet other embodiments, the arms 766*i* are L-shaped, similarly to the jaws 742. As seen in FIG. 33 for attachment 722*b*, in some embodiments only one arm 766*b* is provided. In other embodiments, as seen for attachment 722*c* of FIG. 34, two rectilinear arms 766*c* diverging from each other are provided. However, converging arms 766*d*, seen in FIG. 35 for attachment 722*d* having a curved jaw 742*d*, or parallel arms 766*e*, seen in FIG. 36 for attachment 722*e* having a curved jaw 742*e* are usable. The various configurations of the arms 766 to 766*i* described above are selected according to the properties of the foldable material 735 so that the attachments 722 to 722*j* are properly held in place in the foldable material 735 while being relatively easy to attach thereto.

Figure 38:
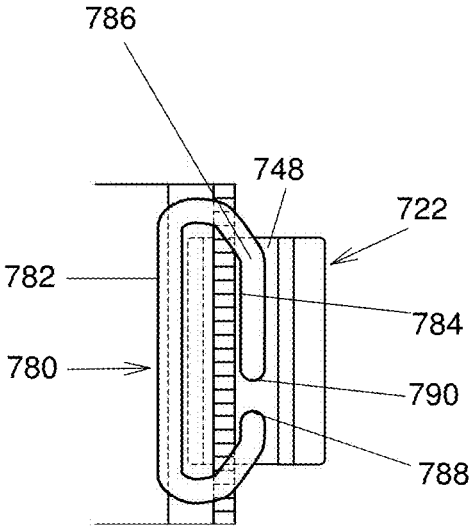
FIG. 38, in a front elevation view with parts removed, illustrates a locking clip usable with the garment extender of FIG. 22.

Referring to FIG. 38, in some embodiments, a locking clip 780 is provided. The locking clip 780 defines a clip body 782 and a locking portion 784 extending from the clip body 782. The locking portion 784 is removably insertable in the channel 748 when the attachment 722 is operatively attached to the garment slide fastener 14. The locking portion 784 increases frictional forces between the attachment mount 733 (not seen in FIG. 38) and the garment slide fastener 14 relative to a configuration in which the locking portion 784 is outside of the channel, helping in ensuring that the garment extender 10 remains fixed relative to the garment 12. It should be noted that the presence of the foldable material 735 (not shown in FIG. 38 for clarity) in the channel 748 is advantageous as this foldable material will provide a cushioning effect that allows use of a single locking clip 780 with teeth 18 of various dimensions.

Figure 39:
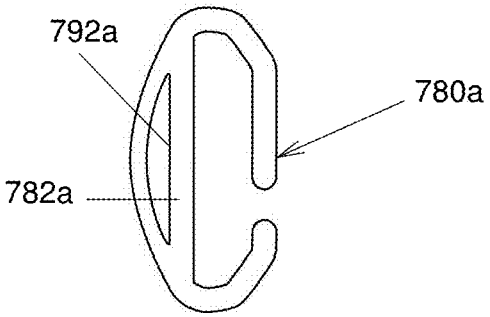
FIG. 39, in a front elevation view, illustrates an alternative locking clip usable with the garment extender of FIG. 22.

For example, the locking portion 784 is rectilinear and the clip body 782 is substantially C-shaped and defines clip body first and second ends 786 and 788. The locking portion 784 extends from the clip body 782 at the clip body first end 786. There is a gap 790 between the clip body second end 788 and the locking portion 784. The locking clip 780 is for example made of a resiliently deformable material, such as a suitable polymer or metal. The locking clip 780 is configured so that the locking portion 784 can be slid along the channel 748 until the gap 790 is outside of the channel 748, at which point the locking clip 780 can be deformed so that the clip body second end 788 clears the attachment 722, which allows removal of the locking portion 784 from the channel 748 by sliding the locking portion 784 therealong. Attachment of the clip 780 proceeds by following these steps in reverse. The locking clip 780 is configured so that it remains secured to the attachment 722 unless the gap 790 is positioned outside of the channel 748. For example, the clip is configured so that unless sufficient external forces are exerted thereonto, the gap 790 remains inside the channel 748. As seen in FIG. 39, in alternative embodiments, a locking clip 780*a* has a clip body 782*a* defining an aperture 792*a* thereinto, allowing to secure the locking clip 780*a* to the garment extender 10 using a rope or in any other suitable manner (not shown in the drawings) so that the locking clip 780*a* is less likely to be lost.

Figure 41:
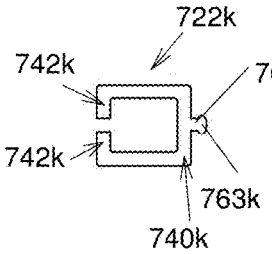
FIG. 41, in top cross-sectional view midway therethrough, illustrates the attachment of FIG. 40.
Figure 40:
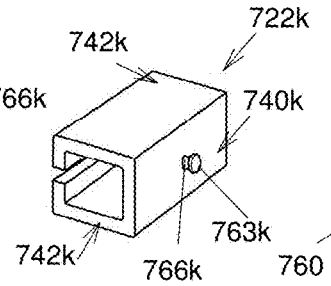
FIG. 40, in a perspective view, illustrates yet another alternative attachment usable in the garment extender of FIG. 22.
Figure 42:
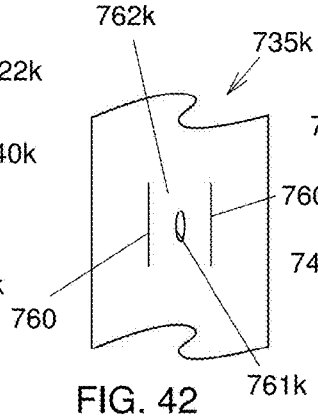
FIG. 42, in a perspective view, illustrates part of an alternative foldable material usable with the attachment of FIG. 41.
Figure 43:
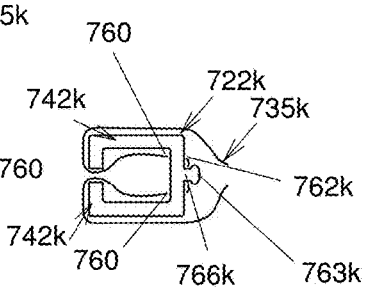
FIG. 43, in top cross-sectional view midway through the attachment, illustrates the attachment of FIGS. 40 and 41 mounted to the foldable material of FIG. 42.

FIGS. 40 and 41 illustrate yet another attachment 722*k* that omits the arms 766. Instead, a prong 766*k* extends from the body central portion 740*k* opposed to the jaws 742*k*. As seen in FIG. 42, the foldable material 735*k* defines a prong receiving aperture 761*k* in the inter-aperture portion 762*k*. When the attachment 722*k* is mounted to the foldable material 735*k* similarly to the manner described hereinabove with respect to the attachment 722, the prong 766*k* protrudes through the prong receiving aperture 761*k*, as seen in FIG. 43, which helps in maintaining the attachment 722*k* at a suitable location in the foldable material 735*k*. In some embodiments, the prong 766*k* terminates with a head 763*k* larger than the remainder of the prong 766*k* and sized relative to the prong receiving aperture 761*k* so that the head 763*k* is insertable in the prong receiving aperture 761*k*, but not easily removable therefrom accidentally. For example, insertion and removal of the head 763*k* from the prong receiving aperture 761*k* may require slightly stretching or otherwise deforming the foldable material 735.

Figure 45:
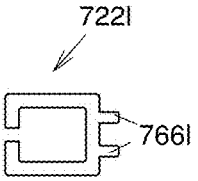
FIG. 45, in top plan view, illustrates the attachment of FIG. 44.
Figure 44:
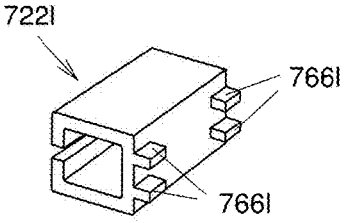
FIG. 44, in a perspective view, illustrates yet another alternative attachment usable in the garment extender of FIG. 22.
Figure 46:
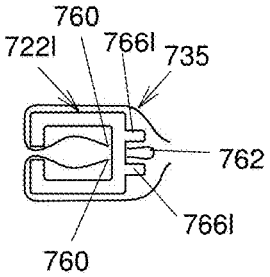
FIG. 46, in top cross-sectional view adjacent a top end of the attachment, illustrates the attachment of FIGS. 44 and 45 mounted to the foldable material of FIG. 27.

In the attachment 722, the arms 766 extend along the whole length of the attachment 722. However, as seen in the alternative attachment 722l shown in FIGS. 44 to 46, in other embodiments, the arms 766l of an attachment 722l extend each along only part of the length of the attachment 722l. In that case, more than two arms 766l may be provided, for example two pairs of arms 766l, one at each end of the attachment 722l.

With the attachments 722 to 722l, the attachments 722 to 722l are movable relative to the foldable material 735, and it is the configuration of the attachments 722 and 722l and the manner in which they are inserted in the foldable material 735 that ensures that the attachments 722 to 722l remain fixed relative to the foldable material 735. In other embodiments, as shown below, attachments may be secured to the folding material 735 using an adhesive, stitches, a fastener or by pinching part of the folding material 735.

Figure 48:
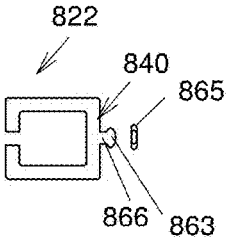
FIG. 48, in top cross-sectional view midway therethrough, illustrates the attachment of FIG. 47.
Figure 47:
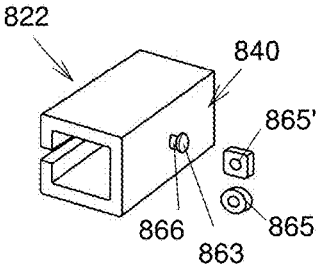
FIG. 47, in a perceptive view, illustrates yet another alternative attachment usable in the garment extender of FIG. 22.
Figure 49:
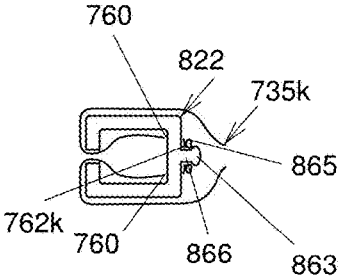
FIG. 49, in top cross-sectional view midway through the attachment, illustrates the attachment of FIGS. 47 and 48 mounted to the foldable material of FIG. 42.

Referring to FIGS. 47 to 49, there is shown an attachment 822 similar to the attachment 722*k* in that it includes a prong 866 insertable in the prong receiving aperture 761*k* of the foldable material 735*k*, as seen in FIG. 49. However, the attachment 822 further includes a fastener 865 or 865' in the form of respectively a square or round washer that is insertable on the prong 866 to pinch the foldable material 735*k* between the attachment body 840 and the fastener 865 or 865'. It should be noted that although FIG. 47 illustrates two different fasteners 865 or 865', typically only one of the fasteners 865 or 865' is used, although use of both fasteners is within the scope of the invention. The fastener 865 or 865' typically snaps in place when inserted on the head 863 so that accidental removal of the fastener 865 or 865' from the prong 866 is unlikely.

Figure 51:
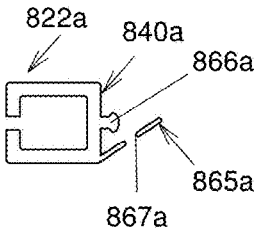
FIG. 51, in top cross-sectional view midway therethrough, illustrates the attachment of FIG. 50.
Figure 50:
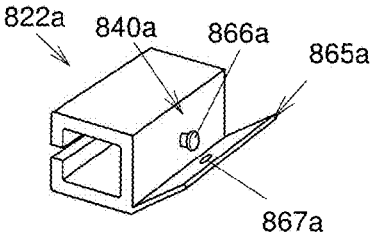
FIG. 50, in a perceptive view, illustrates yet another alternative attachment usable in the garment extender of FIG. 22.
Figure 52:
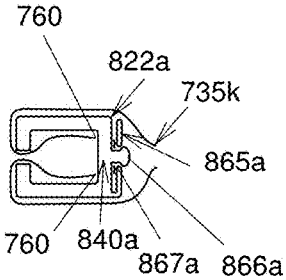
FIG. 52, in top cross-sectional view midway through the attachment, illustrates the attachment of FIGS. 50 and 51 mounted to the foldable material of FIG. 42.

In another embodiment, an attachment 822*a* similar to the attachment 822 and shown in FIGS. 50 to 52 includes an alternative fastener 865*a* taking the form of a panel in which an aperture 867*a* is provided, the prong 866*a* being configured to snap to the fastener 865*a* when the prong 866*a* is inserted in the aperture 877*a*. In some embodiments, the fastener 865*a* is hinged to the attachment body 840*a* so attachment of the fastener 865*a* to the prong 866*a* is facilitated.

Figure 53:
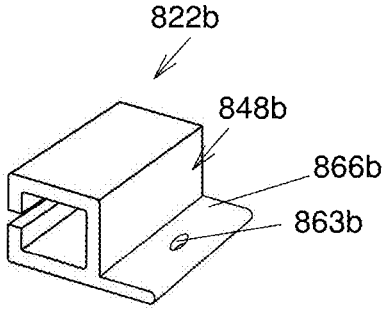
FIG. 53, in a perceptive view, illustrates yet another alternative attachment usable in the garment extender of FIG. 22.
Figure 54:
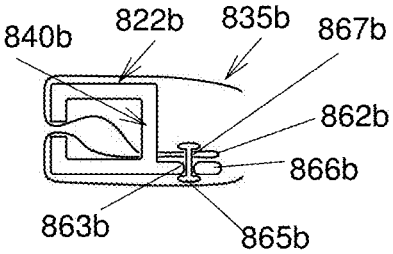
FIG. 54, in top cross-sectional view midway through the attachment, illustrates the attachment of FIG. 53 mounted to an alternative foldable material shown in FIG. 67.

FIGS. 53 and 54 illustrate an other alternative attachment 822*b*. In this embodiment, the foldable material 835*b*, seen in FIG. 54 and illustrated separately in FIG. 67, is not secured to the body central portion 848*b* but to an arm 866*b* extending therefrom, using for example a fastener 865*b* in the form of a rivet. To that effect, the arm 866*b* defines an arm aperture 863*b* and a pair of rivet apertures 867*b* are provided in the inter-aperture portion 862*b* of the foldable material 835*b*. The rivet apertures 867*b* are configured and positioned so that when the attachment 822*b* is mounted to the foldable material 835*b* and the latter is folded so that the two rivet apertures 867*b* are in register with each other, the arm aperture 863*b* is in register with the rivet apertures 867*b* so that the fastener 865*b* can be inserted therethrough to secure the foldable material 835*b* to the arm 866*b*.

Figure 55:
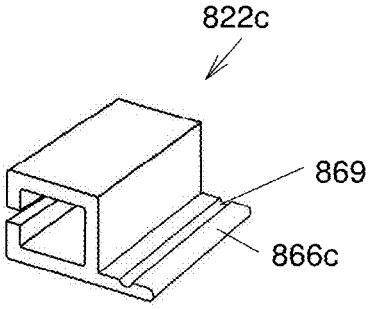
FIG. 55, in a perceptive view, illustrates yet another alternative attachment usable in the garment extender of FIG. 22.
Figure 56:
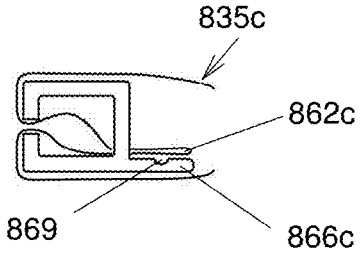
FIG. 56, in top cross-sectional view midway through the attachment, illustrates the attachment of FIG. 55 mounted to the foldable material of FIG. 27.

FIGS. 55 and 56 illustrate another attachment 822*c* similar to the attachment 822*b* except that the foldable material 835*c* does not necessarily include the rivet apertures 867*b* and the arm aperture 863*b* may be omitted. Instead, the inter-aperture portion 862*c* is secured to the arm 866*c* using for example an adhesive (not shown in FIGS. 55 and 56) provided between the arm 866*c* and the inter-aperture portion 862*c* or stitches (not shown in FIGS. 55 and 56) extending through both the arm 866*c* and the inter-aperture portion 762*c*. In some embodiments, a groove 869 is formed along the arm 866*c* to receive the adhesive or to provide a thinner portion of the arm 866*c* that facilitates stitching therethrough.

FIGS. 57 to 60B illustrate yet another attachment 822*d* and FIGS. 61 to 64 illustrate yet another attachment 822*e* that use respectively one or two fasteners 865*d* and 865*e*, for example rivets. The attachments 822*d* and 822*e* both omit the arms 766 and prong 866 and are substantially C-shaped. In the attachments 822*d* and 822*e*, one or more fasteners 865*d* or 865*e* are configured and sized to engage both the attachment 822*d* or 822*e* and the foldable material 835*d* or 835*e* so that the foldable material 835*d* or 835*e* is secured to the attachment body 840*d* or 840*e* or the jaws 842*d* or 840*e*. A fastener receiving aperture 863*d* extends through the body central portion 840*d* of the attachment 822*d*. A fastener receiving aperture 863*e* extends through each of the jaws 842*e* of the fastener 822*e*. The foldable material 835*d* used with the fastener 822*d* defines a rivet receiving aperture 867*d* and the foldable material 835*e* used with the fastener 822*e* defines a pair of rivet receiving aperture 867*e*. The rivet receiving apertures 867*d* and 867*e* are positioned and configured to be in register with the fastener receiving aperture 863*d* and 863*e* when the foldable material 835*d* and 835*e* is inserted in the channel 848*d* and 848*e* of respectively the attachments 822*d* and 822*e* so that each fastener 865*d* or 865*e* can be inserted through the fastener receiving apertures 863*d* and 863*e* and the rivet receiving apertures 867*d* and 867*e* to secure the foldable material 835*d* and 835*e* to the attachments 822*d* and 822*e* when the fastener 865*d* and 865*e* is suitably locked to the attachments 822*d* and 822*e*, as seen respectively in FIGS. 60A and 64. It should be noted that in these embodiments, the apertures 760 may be omitted. The foldable material 835*d* and 835*e* can then be folded over the remainder of the attachment 822*d* and 822*e* as in the attachment 722. As seen in FIG. 60B, in other embodiments the apertures 760 are provided and the fastener 865*d* acts similarly to the prong 866.

FIGS. 65 to 68 illustrate yet another attachment 822*f* that combines features of the attachments 822*b* and 822*a*. In the attachment 822*f*, a single arm 866*f* defining an arm aperture 869*f* extending therethrough extends from the middle of the central body portion 848*f*. A fastener 865*f* is hinged to the arm 866*f* and includes a prong 861*f* positioned for engaging and snapping to the arm aperture 869*f* when the fastener 865*f* is folded over the arm 866*f*. The rivet apertures 867*b* are positionable in register with the arm aperture 869*f* so that the prong 861*f* can extend therethrough. When the attachment 822*f* is mounted to the foldable material 835*b*, the foldable material 835*b* is pinched between the fastener 865*f* and the arm 866*f*.

Figure 70:
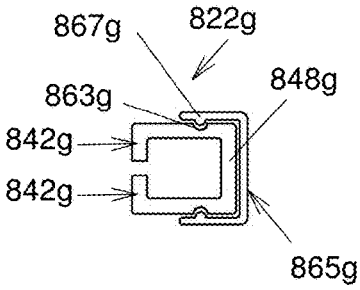
FIG. 70, in top cross-sectional view midway therethrough, illustrates the attachment of FIG. 69.
Figure 69:
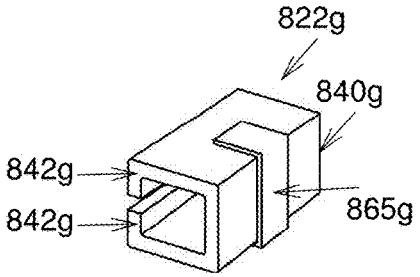
FIG. 69, in a perspective view, illustrates yet another alternative attachment usable in the garment extender of FIG. 22.
Figure 71:
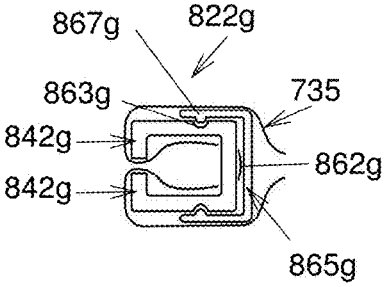
FIG. 71, in top cross-sectional view midway through the attachment, illustrates the attachment of FIGS. 69 and 70 mounted to the foldable material of FIG. 27.
Figure 72:
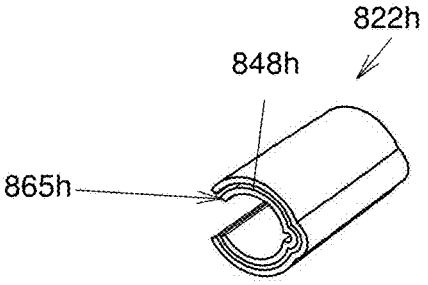
FIG. 72, in a perspective view, illustrates yet another alternative attachment usable in the garment extender of FIG. 22.
Figure 73:
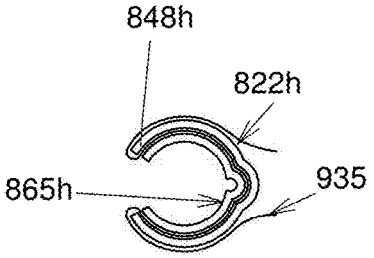
FIG. 73, in top cross-sectional view midway through the attachment, illustrates the attachment of FIG. 72 mounted to an unpierced foldable material.
Figure 74:
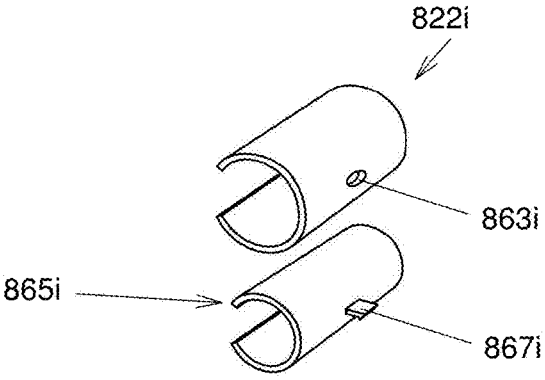
FIG. 74, in a perspective exploded view, illustrates yet another alternative attachment usable in the garment extender of FIG. 22.
Figure 75:
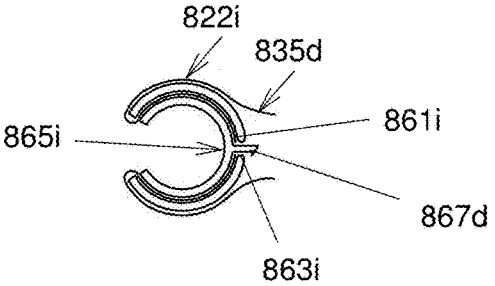
FIG. 75, in top cross-sectional view midway through the attachment, illustrates the attachment of FIG. 75 mounted to the foldable material of FIG. 59.

FIGS. 69 to 71 illustrate yet another type of fastener 865*g* usable with an attachment 822*g* similar to the attachment 822 in which the prong 866 is omitted. Instead, the fastener 865*g* is substantially C-shaped and conforms to the shape of the body central portion 848*g* and part of the jaws 842*g*. The fastener 865*g* includes protrusions 867*g* positioned to engage correspondingly shaped recesses 863*g* formed in the jaws 842*g*. It should be noted that jaws including the protrusion and the fastener including the recess is also within the scope of the invention. The fastener 865*g* is resiliently deformable and configured to snap in place when the protrusions 867*g* are in register with the recesses 863*g*, thereby attaching the fastener 865*g* to the attachment 822*g* with the inter-aperture portion 862*g* pinched therebetween. As seen in FIGS. 72 and 73, in other embodiments the fastener 865*h* may instead be insertable in the channel 848*h* of the attachment 822*h*, and both the attachment 822*h* and the fastener 865*h* may be substantially C-shaped, with a recessed portion present in both that engage each other to prevent undesired rotations therebetween. The attachment 822*h* works similarly to the attachment 822*d*, except that the aperture 863*d* may be omitted and replaced by a protrusion/recess pair, as in the attachment 822*g* and fastener 865*g* assembly. However, as seen in FIGS. 74 and 75, the fastener 865*i* may be usable with the foldable material 835*d* and include a prong 867*i* inserted in a suitable positioned aperture 863*i*, In such embodiments, the prong extends through a suitable formed aperture 867*d* formed in the foldable material 835*d*.

Figure 77:
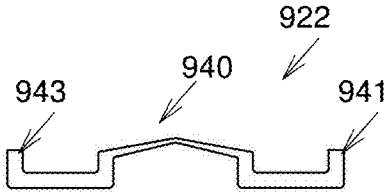
FIG. 77, in top cross-sectional view midway therethrough, illustrates the attachment of FIG. 76, the attachment being shown in a second configuration.
Figure 76:
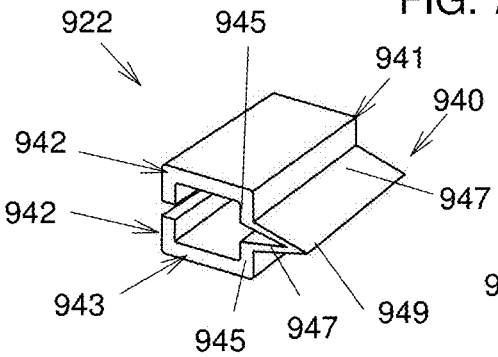
FIG. 76, in a perceptive view, illustrates yet another alternative attachment usable in the garment extender of FIG. 22, the attachment being shown in a first configuration.
Figure 78:
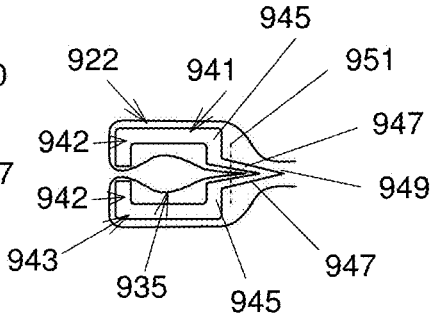
FIG. 78, in top cross-sectional view midway through the attachment, illustrates the attachment of FIGS. 76 and 77 mounted to an unpierced foldable material.

In yet other embodiments, the foldable material is pinched between two portions of a two parts attachment body, which are then secured to each other in any suitable manner. An example of an attachment 922 using this principle is shown in FIGS. 76 to 78. In the attachment 922, the attachment body 940 includes attachment body first and second portions 941 and 943 from which a respective one of the jaws 942 extends. When the attachment 922 is mounted to the foldable material 935, the body first and second portions 941 and 943 are secured to each other with at least part of the foldable material 935 contained between the body first and second portions 941 and 943, as seen in FIG. 78.

To that effect, the attachment body first and second portions 941 and 943 are each substantially L-shaped, with a central portion 945 corresponding to the body central portion 758, and an arm portion 947 extending therefrom away from the jaws 942. When the body first and second portions 941 and 943 are secured to each other, the arm portions 947 are substantially parallel and adjacent to each other and pinch the foldable material 935 therebetween. In the embodiment shown in FIGS. 76 to 78, the arm portions 947 are secured to each other to form a hinge 949 opposed to the central portions 945, but in other embodiments, the body first and second portions 941 and 943 are not permanently attached to each other before the attachment 922 is mounted to the foldable material 935.

The attachment 922 is mounted to the the foldable material 935 similarly to the attachment 822*h* in that no apertures are needed in the foldable material 935. To mount the attachment 922, the attachment 922 is laid with the hinge 949 open, and seen in FIG. 77, and the foldable material 935 (not seen in FIG. 77) is laid flat on the open attachment 922, which is then closed to achieve the configuration of FIG. 76, which pinches the foldable material 935 between the arm portions 947. Stitches 951, represented schematically in FIG. 78, passing through the arm portions 947 and the portion of the foldable material 935 pinched therebetween can then be used to secure the arm portions 947 to each other so that the foldable material 935 has a portion thereof that remains secured between the arm portions 947. Then, the remainder of the foldable material 935 can be folded over the remainder of the attachments 922 as described hereinabove to cover the attachment 922.

Figure 79:
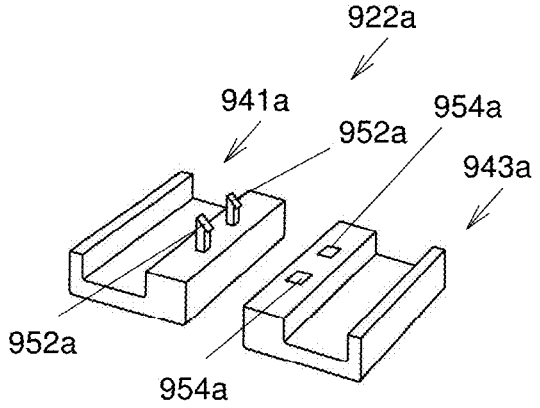
FIG. 79, in a perceptive view, illustrates yet another alternative attachment usable in the garment extender of FIG. 22.

FIG. 79 illustrates yet another attachment 922*a* mounted to the foldable material 935*a* (seen in FIGS. 80 and 81) using a similar manner, except that no stitches 951 are required and that the body first and second portions 941*a* and 943*a* are not hinged to each other. Instead the body first and second portions 941*a* and 943*a* are manufactured detached from each other and attached to each other afterwards. For example, the body first portion 941*a* defines at least one prong 952*a* (here two prongs 952*a* are defined) and the body second portion defines a corresponding number of prong receiving recesses 954*a*. When the attachment 922*a* is mounted to the foldable material 935*a*, the prongs 952*a* each engage a corresponding prong receiving recess 954*a* so that the prong 952*a* is locked in the prong receiving recess 954*a* to lock the body first and second portions 941*a* and 943*a* to each other. Such prongs and apertures are known in the art and may for example involve a prong 952*a* having a hooked free end configured to engage a ledge formed at the opening of the prong receiving recess 954*a*. When the prongs 952*a* are suitably resiliently deformed, they can enter the prong receiving recesses 954*a* until the resilient deformation is allowed to reverse due to the configuration of the prong receiving recesses 954*a*, at which point the body first and second portions 941*a* and 943*a* are joined to each other. Other types of prongs and corresponding recesses are also within the scope of the invention.

Figure 80:
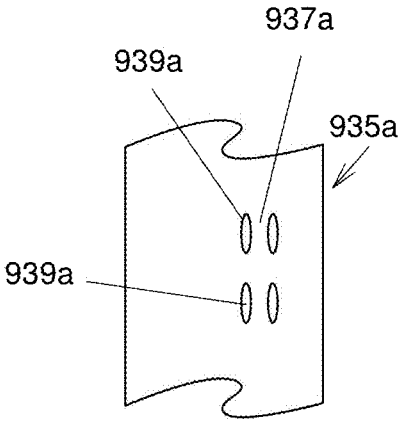
FIG. 80, in a perspective view, illustrates part of another alternative foldable material.
Figure 81:
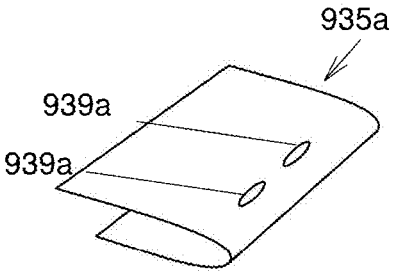
FIG. 81, in a perspective view, illustrates the foldable material of FIG. 80 folded over itself prior to mounting the attachment of FIG. 79 thereto.
Figure 82:
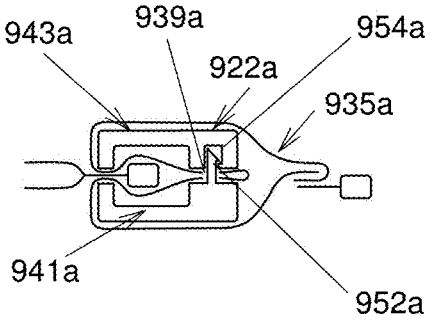
FIG. 82, in top cross-sectional view midway through a prong of the attachment, illustrates the attachment of FIG. 79 mounted to the foldable material of FIGS. 80 and 81.

The prongs extend through a pinched portion 937*a* of the foldable material 935*a*, for example through suitably located pinched portion apertures 939*a* seen in FIGS. 80 and 81. More specifically, a pair of pinched portion apertures 939*a* may be provided for each prong 952*a* and the foldable material 935*a* may be folded so that the pinched portion apertures 939*a* within each pair are in register with each other. The foldable material 935*a* is then positioned so that the prongs 952*a* are inserted in the pinched portion apertures 939*a* and the body second portion 943*b* may then be mounted to pinch the pinched portion 937*a* between the body first and second portions 941*a* and 943*a*. Afterwards, the foldable material 935*a* can be folded over the remainder of the attachment 922*a* as in the attachment 922, as seen in FIG. 82.

Figure 91:
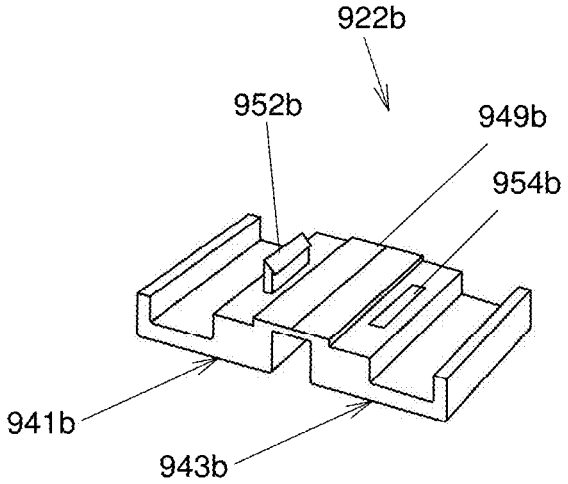
FIG. 91, in a perceptive view, illustrates yet another alternative attachment usable in the garment extender of FIG. 22.
Figure 92:
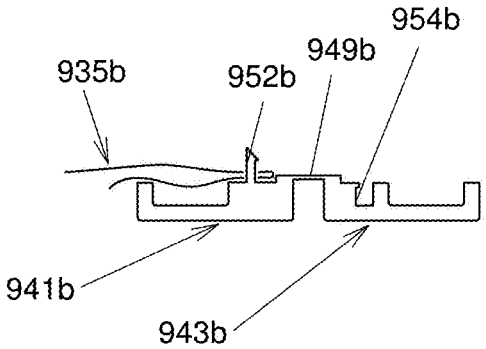
FIG. 92, in top cross-sectional view midway therethrough, illustrates the attachment of FIG. 91 partially mounted to an alternative foldable material.
Figure 93:
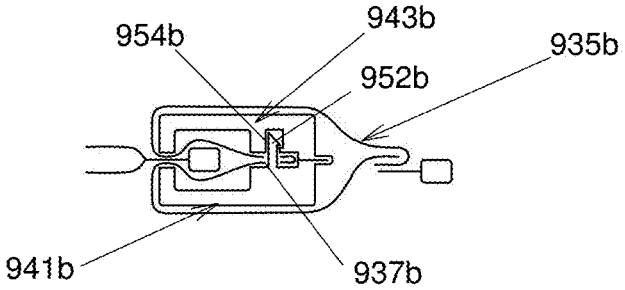
FIG. 93, in top cross-sectional view midway therethrough, illustrates the attachment of FIGS. 91 and 92 mounted to the alternative foldable material shown in FIG. 92.

FIGS. 91 to 93 illustrate an attachment 922*b* that incorporates aspects of both attachment 922 and 922*a*. More specifically, a hinge 949*b* extends between substantially L-shaped body first and second portions 941*b* and 943*b*, similarly to the attachment 922, but instead of stitches, a combination prong 952*b* and prong receiving recesses 954*b* is used to lock the body first and second portions 941*b* and 943*b* to each other. Only one prong 952*b* and prong receiving recess 954*b* pair is provided, but any other suitable number is usable. Since there is only one prong 952*b*, the foldable material 935*b* can define a single pair of suitably shaped prong receiving apertures 937*b*.

Figure 84:
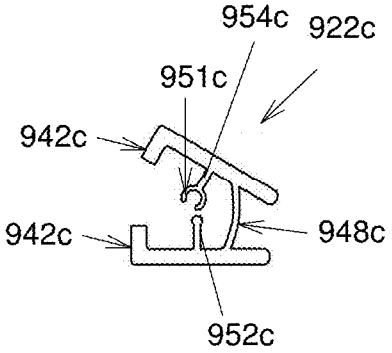
FIG. 84, in top cross-sectional view midway therethrough, illustrates the attachment of FIG. 83.
Figure 83:
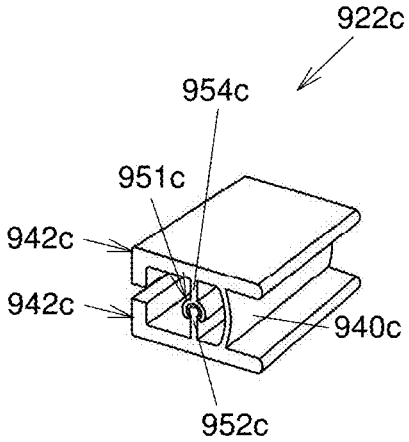
FIG. 83, in a perceptive view, illustrates yet another alternative attachment usable in the garment extender of FIG. 22.
Figure 85:
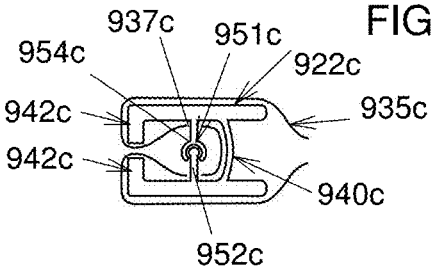
FIG. 85, in top cross-sectional view midway through the attachment, illustrates the attachment of FIGS. 83 and 84 mounted to the foldable material of FIG. 27.

Yet another type of attachment 922*c* is seen in FIGS. 83 to 85. The attachment 922*c* is similar to the attachment 722*g* except that it includes a resiliently deformable body central portion 948*c* allowing opening and closing of the jaws 942*c* and a lock 951*c* provided between the two jaws 942*c*. The foldable material 935*c* is not pinched by the attachment 922*c*, but defines a pair of lock receiving apertures 937*c* that receive the lock 951*c* therethrough after the foldable material 935*c* is folded over itself as in the attachment 922. The lock 951*c* includes lock first and second portions 952*c* and 954*c* that each extend from a respective jaw and which are configured to snap to each other during the attachment 922*c* mounting process.

Figure 86:
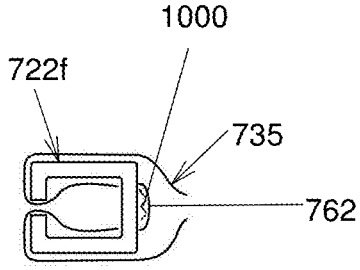
FIG. 86, in top cross-sectional view midway through the attachment, illustrates an alternative manner of mounting the attachment of FIG. 29 to the foldable material of FIG. 27.

The above-described attachments may, in some embodiments, not require the use of glue or other adhesives to mount the attachment to the foldable material. However, in other embodiments, such an adhesive is used. As seen for example in FIG. 86 in which the attachment 722*f* is secured to the inter-aperture portion 762 using an adhesive 1000. FIG. 86 is only one example of how an adhesive 1000 may be used to secure foldable materials to attachments and other variants are also within the scope of the invention.

Figure 87:
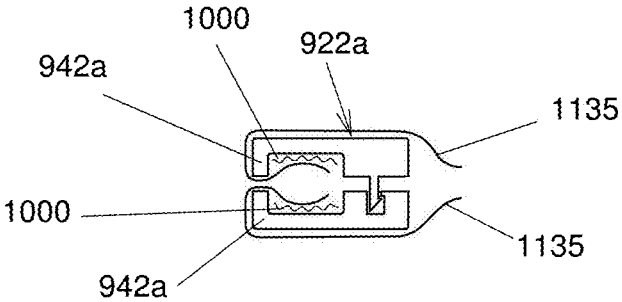
FIG. 87, in top cross-sectional view midway through a prong of the attachment, illustrates an alternative manner of mounting the attachment of FIG. 79 to two unpierced foldable materials.
Figure 88:
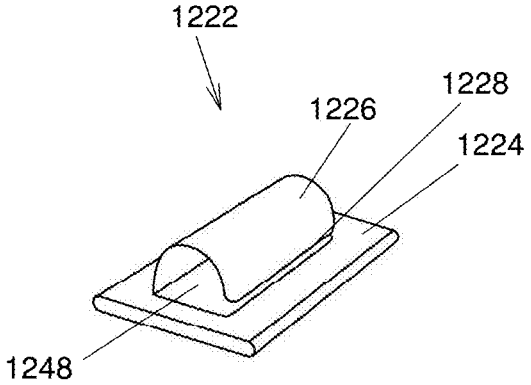
FIG. 88, in a perceptive view, illustrates yet another alternative attachment usable in the garment extender of FIG. 22.

Also, the above-described attachments have been described as attaching to a single piece of foldable material. However, referring to FIG. 87, if an adhesive is used, two pieces of foldable materials 1135 may each be secured inside a respective jaw 942*a* of an attachment, for example the attachment 922*a*, using the adhesive 1000, instead of pinching the foldable material 935*a* as described hereinabove. The foldable material 1135 is then folded over the attachment 922*a* as described hereinabove. The other attachments described herein could also be similarly adhered to the foldable material in a similar manner. In such embodiments, the foldable material 1135 exposed to the environment when used may be made of a weatherproofed material, while the foldable material 1135 provided closer to the intended user may be softer, for example made of fleece.

Figure 90:
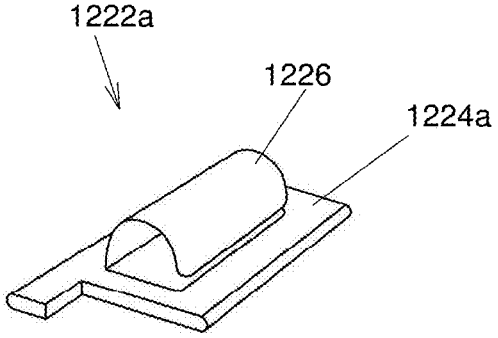
FIG. 90, in a perceptive view, illustrates yet another alternative attachment usable in the garment extender of FIG. 22.
Figure 89:
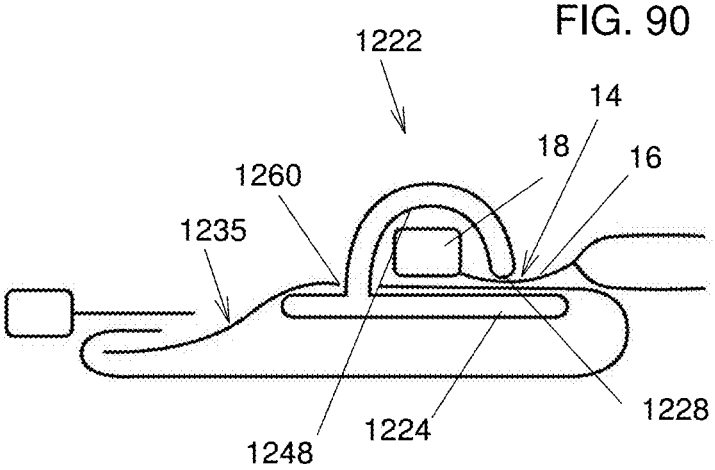
FIG. 89, in top cross-sectional view midway therethrough, illustrates the attachment of FIG. 88 mounted to an alternative foldable material.

FIG. 89 illustrates another manner of mounting an attachment 1222. The attachment 1222 defines a substantially flat base 1224, which is for example rectangular, although other shapes, such as, non-limitingly, an L-shaped base 1224*a*, seen in FIG. 90 for attachment 1222*a*, is within the scope of the invention. An arcuate clip 1226 extends from the base and curves back towards the base 1224 so as to define a gap 1228 therebetween. The interior of the clip 1226 forms the channel 1248, while the gap 1228 acts like the slit 750. The foldable material 1235 defines a single slit 1260 receiving the clip 1226 therethrough so that the base 1224 is entirely received into a cavity defined in the foldable material 1235, while the clip 1226 is outside of the cavity and is therefore not covered by the foldable material 1235. The attachment 1222 is free floating in the cavity or adhered or stitched to the foldable material 1235.

Although the present invention has been described hereinabove by way of exemplary embodiments thereof, it will be readily appreciated that many modifications are possible in the exemplary embodiments without materially departing from the novel teachings and advantages of this invention. Accordingly, the scope of the claims should not be limited by the exemplary embodiments, but should be given the broadest interpretation consistent with the description as a whole.

What is claimed is:

1. A garment extender usable with a garment having a garment slide fastener, the garment slide fastener having a pair of substantially elongated stringer tapes supporting each a row of teeth extending longitudinally therealong, the garment slide fastener also having a slider movable along the rows of teeth in a reciprocating movement for selectively attaching the teeth of both rows to each other when moved in a closing direction and selectively detaching the teeth of both rows from each other when moved in an opening direction opposed to the closing direction, the garment extender comprising:

an extender body defining substantially opposed extender body first and second side edges and opposed extender body top and bottom edges extending each between the extender body first and second side edges;

at least two attachment mounts provided each at a respective one of the extender body first and second side edges;

at least two attachments, each mounted to a respective one of the attachment mounts, each of the attachments including an attachment body and a pair of jaws extending from the attachment body, each jaw terminating at a respective jaw free end, the jaws delimiting a channel therebetween opened at both channel ends thereof and the jaw free ends defining a slit therebetween leading to the channel, each jaw defining opposed jaw inner and outer surfaces, the jaw inner surfaces facing each other with the channel therebetween;

wherein each attachment mount includes a foldable material and the attachments are made of polymer or metal material, the attachment being mounted to the attachment mount with the foldable material running along the jaws so that the jaw inner surfaces, outer surfaces and free ends are covered by the foldable material;

wherein, with the attachments operatively secured to the garment slide fastener, the slit of each attachment receives thereinto a gripped portion of one of the stringer tapes and the channel of each attachment receives thereinto the teeth that are supported by the stringer tape adjacent the gripped portion, the foldable material being between the jaws inner surfaces and the teeth and between the stringer tapes and the jaw free ends.

2. The garment extender as defined in claim 1, wherein the attachment body defines a body central portion from which the jaws extend, the foldable material defining a pair of apertures, an inter-aperture portion therebetween and a pair of extra-aperture portions extending away from each other from a respective one of the apertures opposed to the inter-aperture portion, the attachment being mounted to the foldable material with the body central portion inserted through both apertures, the extra-aperture portions each extending from a respective one of the apertures and covering a respective one of the jaws.

3. The garment extender as defined in claim 2, wherein the extra-aperture portions each extend along a respective one of the jaw inner surfaces, jaw free ends and jaw outer surfaces.

4. The garment extender as defined in claim 2, wherein a pair of arms extends from the body central portion away from the jaws, at least part of the inter-aperture portion being received between the arms.

5. The garment extender as defined in claim 4, wherein the extra-aperture portions further extend over the attachment body and are joined to each other so that the attachments are contained in a cavity defined by the foldable material with only the body central portion protruding out of the cavity.

6. The garment extender as defined in claim 4, wherein the arms are angled so as to converge towards each other in a direction leading away from the body central portion.

7. The garment extender as defined in claim 2, wherein a prong extends from the body central portion opposed to the jaws, the foldable material defining a prong receiving aperture in the inter-aperture portion, the prong protruding through the prong receiving aperture.

8. The garment extender as defined in claim 7, further comprising a fastener secured to the prong, the foldable material being secured to the prong between the body central portion and the fastener.

9. The garment extender as defined in claim 2, further comprising a fastener, the fastener being configured and sized to engage both the attachment and the foldable material so that the foldable material is secured to the attachment.

10. The garment extender as defined in claim 2, wherein an arm extends from the body central portion away from the jaws, at least part of the inter-aperture portion being secured to the arm.

11. The garment extender as defined in claim 1, wherein the jaws have bevelled jaw free end portions so that the slit defines flared slit ends.

12. The garment extender as defined in claim 1, wherein the attachment has a substantially C-shaped cross-sectional configuration in a plane substantially perpendicular to the channel.

13. The garment extender as defined in claim 1, wherein at least one of the jaws has one of a substantially L-shaped transversal cross-sectional configuration, a substantially arcuate transversal cross-sectional configuration, or a substantially rectilinear transversal cross-sectional configuration.

14. The garment extender as defined in claim 1, wherein the foldable material includes cloth.

15. The garment extender as defined in claim 1, further comprising a locking clip, the locking clip defining a clip body and a locking portion extending from the clip body, the locking portion being removably insertable in the channel when the attachment is operatively attached to the garment slide fastener, whereby the locking portion increases frictional forces between the attachment mount and the garment slide fastener relative to a configuration in which the locking portion is outside of the channel.

16. The garment extender as defined in claim 1, wherein the attachment body includes attachment body first and second portions from which a respective one of the jaws extends, the body first and second portions being secured to each other with at least part of the foldable material contained between the body first and second portions.

17. The garment extender as defined in claim 16, wherein the body first and second portions are secured to each other with at least part of the foldable material pinched between the body first and second portions.

18. The garment extender as defined in claim 17, wherein the foldable material defines a pinched portion pinched between the body first and second portions and a pair of covering portion extending from the pinched portion, each of the covering portion covering a respective one of the jaws.

19. The garment extender as defined in claim 18, wherein the body first and second portions and the pinched portion are stitched to each other.

20. The garment extender as defined in claim 16, wherein the body first portion defines a prong and the body second portion defines a prong receiving recess, the prong engaging the prong receiving recess so that the prong is locked in the prong receiving recess to lock the body first and second portions to each other;

the prong extends through the pinched portion.

21. A garment extender usable with a garment having a garment slide fastener, the garment slide fastener having a pair of substantially elongated stringer tapes supporting each a row of teeth extending longitudinally therealong, the garment slide fastener also having a slider movable along the rows of teeth in a reciprocating movement for selectively attaching the teeth of both rows to each other when moved in a closing direction and selectively detaching the teeth of both rows from each other when moved in an opening direction opposed to the closing direction, the garment extender comprising:

an extender body defining substantially opposed extender body first and second side edges and opposed extender body top and bottom edges extending each between the extender body first and second side edges;

at least two elongated attachment mounts provided along a respective one of the extender body first and second side edges;

a plurality of attachments each mounted to one of the attachment mounts at longitudinally spaced apart locations, each of the attachments including an attachment body and a pair of jaws extending from the attachment body, each jaw terminating at a respective jaw free end, the jaws delimiting a channel therebetween opened at both channel ends thereof and the jaw free ends defining a slit therebetween leading to the channel, each jaw defining opposed jaw inner and outer surfaces, the jaw inner surfaces facing each other and delimiting the channel;

wherein, with the attachments operatively secured to the garment slide fastener, the slit of each attachment receives thereinto a gripped portion of one of the stringer tapes and the channel of each attachment receives thereinto the teeth that are supported by the stringer tape adjacent the gripped portion;

wherein each attachment mount includes a foldable material and the attachments are made of polymer or metal material, the attachment being embedded at least partially in the foldable material.

* * * * *